US008500563B2

(12) United States Patent
Román et al.

(10) Patent No.: US 8,500,563 B2
(45) Date of Patent: Aug. 6, 2013

(54) DISPLAY, DEVICE, METHOD, AND COMPUTER PROGRAM FOR INDICATING A CLEAR SHOT

(75) Inventors: Kendyl A. Román, Sunnyvale, CA (US); John Livacich, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 0 days.

(21) Appl. No.: 13/599,450

(22) Filed: Aug. 30, 2012

(65) Prior Publication Data

US 2013/0059632 A1 Mar. 7, 2013

Related U.S. Application Data

(63) Continuation of application No. 12/859,769, filed on Aug. 19, 2010, now Pat. No. 8,282,493.

(51) Int. Cl.
*A63F 13/00* (2006.01)

(52) U.S. Cl.
USPC ..... 463/51; 463/2; 463/30; 463/31

(58) Field of Classification Search
USPC ..... 463/2, 30, 31, 51
See application file for complete search history.

(56) References Cited

U.S. PATENT DOCUMENTS

| | | | | |
|---|---|---|---|---|
| 5,181,323 | A * | 1/1993 | Cooper | 42/122 |
| 5,566,951 | A * | 10/1996 | Dart et al. | 273/358 |
| 6,144,308 | A * | 11/2000 | Dunne | 340/689 |
| 6,269,581 | B1 * | 8/2001 | Groh | 42/122 |
| 2004/0016058 | A1 * | 1/2004 | Gardiner et al. | 7/119 |
| 2007/0236384 | A1 * | 10/2007 | Ivtsenkov et al. | 342/45 |
| 2008/0192979 | A1 * | 8/2008 | Bee | 382/103 |

* cited by examiner

*Primary Examiner* — James S McClellan

(57) ABSTRACT

A system for indicating to a user a clear shot along a projectile trajectory to a target wherein one of the trajectory path indicators indicates a height of the projectile trajectory at a predetermined intermediate range to the target whereby the user is informed regarding whether or not an obstacle is in the projectile trajectory. The system facilitates accurate, effective, and safe firearm and bow use by providing indications regarding obstacles that are between the shooter and target and which may or may not be in the projectile trajectory. The system may indicate a calibrated aiming point, which is the maximum height of the projectile trajectory. Enhanced rangefinders have digital cameras and high-resolution displays. Some embodiments include a weapon scope, a simulation game device, and a mobile smart phone. A method of using the system.

19 Claims, 35 Drawing Sheets

DISPLAY, DEVICE, METHOD, AND COMPUTER PROGRAM FOR INDICATING A CLEAR SHOT

This application is a continuation of U.S. patent application Ser. No. 12/859,769, filed Aug. 19, 2010 now U.S. Pat. No. 8,282,493 and claims priority based on U.S. patent application Ser. No. 12/859,769.

BACKGROUND

1. Field of the Invention

The present invention relates to a display that provides information regarding a projectile trajectory so that a user is informed whether or not there is a clear shot. The present invention also relates to devices such as handheld rangefinders that would comprise such a display and the methods for indicating a clear shot, some of which may be implemented as computer programs.

2. Description of Prior Art

Bows and arrows, spears, crossbows, guns, and artillery have been used for sport, hunting, and military.

An arrow is typically shot using the arms to pull back the bow string, and to aim and sight by holding the bow and arrow next to the archer's eye. More recently bow sights have been added to all types of bows. Typically a bow sight comprises a plurality of pins that may be adjusted by the archer for aiming at targets at different distances. Some bow sights have a single adjustable pin that is moved to the match the distance to the target.

FIG. 1 shows an archer 100 with a compound bow 102 with a bow sight 110, and an arrow 104.

FIG. 2 shows an example of a bow sight 110 with pins adjusted for twenty yards, forty yards, and sixty yards, namely a twenty-yard pin 220, a forty-yard pin 240, and a sixty-yard pin 260, respectively.

Balls and/or bullets are typically shot from a gun using the arms to aim and sight by aligning the gun sights or gun scope reticle with the target.

Artillery balls and shells are typically shot by adjusting the aim mechanically.

Arrows, spears, balls, bullets, and shells when fired follow a ballistic trajectory. Such projectiles, which are not self-propelled, move through air according to a generally parabolic (ballistic) curve due primarily to the effects of gravity and air drag. The vertex form for a parabolic equation is $y=a(x-h)^2+k$, where the vertex is the point (h, k) and a negative a (−a) is a maximum. The standard form of the parabolic equation is $y=ax^2+bx+c$, where $h=-b/(2a)$ and $k=c-b^2/(4a)$.

Rifle and bow scopes conventionally have been fitted with reticles of different forms. Some have horizontal and vertical cross hairs. Others reticles such as Mil Dot add evenly spaced dots for elevation and windage along the cross hairs. U.S. Pat. No. D522,030, issued on May 30, 2006, shows a SR reticle and graticle design for a scope. Various reticles, such as Multi Aim Point (MAP) and Dot are provided, for example, by Hawke Optics (http://hawkeoptics.com). These reticles are fixed in that the display does not change based on range information. Also, these reticles indicate the approximate hold-over position in that they are positioned under the center of the scope, i.e. below where the cross hairs intersect. They are not necessarily precise, for example, for a specific bow and archer, but are approximation for the general case.

Hunters and other firearm and bow users commonly utilize handheld rangefinders (see device 10 in FIG. 1) to determine ranges to targets. Generally, handheld rangefinders utilize lasers to acquire ranges for display to a hunter. Utilizing the displayed ranges, the hunter makes sighting corrections to facilitate accurate shooting.

For example, U.S. Pat. No. 7,658,031, issued Feb. 9, 2010, discloses handheld rangefinder technology from Bushnell, Inc, and is hereby included by reference. As shown in FIG. 3, a handheld rangefinder device 10 generally includes a range sensor 12 operable to determine a first range to a target, a tilt sensor 14 operable to determine an angle to the target relative to the device 10, and a computing element 16, coupled with the range sensor 12 and the tilt sensor 14, operable to determine a hold over value based on the first range and the determined angle. The range information is displayed on a display 30. A housing 20 contains the elements of the device 10. Bushnell Angle Range Compensation (ARC) rangefinders show the first linear range to the target and also show an angle and a second range, which represents the true horizontal distance to the target. Handheld rangefinders, telescope sights, and other optical devices typically comprise a laser range sensor and an inclinometer.

The range information is superimposed over the image that is seen through the optics. For example, U.S. Pat. No. D453,301, issued Feb. 5, 2002, shows an example of a design for a display for a Bushnell rangefinder, and is hereby included by reference. FIG. 4 shows an exemplary display 30 appearing in a handheld rangefinder device 10.

The ideal hunting target is shown in FIG. 5 where the target T, in this example, a deer, is in an open, level field with no obstacles. In practice, the target is often not at the same level and there are numerous obstacles between the shooter and the target. FIG. 6 shows a more realistic situation. In the field there may be obstacles such as tree branches, bushes, and other wildlife which are not the target and which may interfere with the trajectory of the projectile.

With convention rangefinder and a bow sight there is no correlation between the display of the rangefinder and the user's individual bow sight. To make an effective shot requires several steps. First the user operates the rangefinder to range the target. Second, the user raises the bow and uses the bow sight pins to visualize the shooting area. Third, the user lowers the bow and raises the rangefinder again to find the range to each object that may be a potential obstacle. Fourth, the user lowers the rangefinder and raises the bow to make the shot. All of the movement and time taken during these steps will likely be noticed by the target and allow the target an opportunity to move resulting in having to repeat the process or miss the shot altogether.

What is needed is an improved rangefinder with a display that provides information regarding a projectile trajectory so that a user is informed whether or not there is a clear shot. Further, the improved rangefinder dynamically indicates positions along the trajectory based on ranges accurately determined by the rangefinder, such that the user is informed about the distance to specific obstacles and whether or not the obstacles would interfere with the trajectory of the projectile. Further, for bow use, the indicators on the display need to correspond to the bow sight pins.

SUMMARY OF THE INVENTION

The present invention solves the above-described problems and provides a distinct advance in the art of rangefinder display. More particularly, the invention provides a display that provides information regarding a projectile trajectory so that a user is informed whether or not there is a clear shot. Such information facilitates accurate, effective, and safe firearm and bow use by providing indications regarding obstacles that are between the shooter and target and which may or may not be in the projectile trajectory.

In one embodiment, the present invention provides a rangefinder device for determining clear shot information. The device generally includes a range sensor operable to determine a first range to a target, a tilt sensor operable to determine an angle to the target relative to the device, and a computing element, coupled with the range sensor and the tilt sensor, operable to determine a projectile trajectory and to provide indicators which inform the user whether or not there is a clear shot.

In another embodiment, the rangefinder device automatically scans the points along the projectile trajectory to explicitly provide an indication whether or not there is a clear shot.

In other embodiments, a display is provided having a distance indicator and one or more path indicators, such as a twenty-yard indicator and/or a forty-yard indicator.

In other embodiments, a display dynamically illuminates one or more of a plurality of selectable path indicators to provide information regarding the projectile trajectory.

In another embodiment, a method for determining a clear shot includes manually ranging the target, observing potential obstacles, ranging each obstacle, and confirming that there is a clear shot.

In another embodiment, a method for determining a clear shot includes automatically ranging the target, determining the projectile trajectory, automatically ranging any obstacles, and providing an explicit indication whether or not there is a clear shot.

In other embodiments, a display is provided for games that simulate the operation of the device in a virtual world. These embodiments could include mobile smart phones such as the Apple iPhone and Google Droid and gaming systems such as Nintendo Wii, Sony PlayStation, Microsoft X-Box, and similar devices.

In another embodiment, a lightweight rangefinder comprises a high-resolution display and a digital camera.

In another embodiment, a lightweight rangefinder comprises a mobile smart phone and a range sensor combined in a housing configured to receive and connect electronically to the mobile smart phone.

In another embodiment, a display is provided having virtual bow sight pins.

Accordingly, it is an objective of the present invention to provide a display that provides information regarding a projectile trajectory so that a user is informed whether or not there is a clear shot.

Other aspects and advantages of the present invention will be apparent from the following detailed description of the preferred embodiments and the accompanying drawing figures.

OBJECTS AND ADVANTAGES

Accordingly, the present invention includes the following advantages:

a) To provide a display that provides dynamic information regarding a projectile trajectory.
b) To provide a display that dynamically indicates clear shot to a ranged target.
c) To provide a display that dynamically indicates distances to obstacles in a projectile trajectory.
d) To provide a display that for a projectile trajectory to a ranged target shows a first path indicator, such as a twenty-yard indicator, above the cross hairs over the ranged target.
e) To provide a display that for a projectile trajectory to a ranged target shows a plurality of path indicators, such as a twenty-yard indicator and a forty-yard indicator, above the cross hairs over the ranged target.
f) To provide a display showing a path indicator, such as a twenty-yard indicator, above the cross hairs over the ranged target, which is consistent with a range pin in an individual user's bow and bow sight (or other type of weapon sight).
g) To provide a display showing a plurality of path indicators above the cross hairs over the ranged target, which is consistent with range pins in an individual user's bow and bow sight (or other type of weapon sight).
h) To provide a simple way of calibrating a handheld rangefinder to be consistent with an individual user's bow and bow sight pins (or other type of weapon sight).
i) To provide a display that dynamically indicates a highest point in a projectile trajectory in relation to an image currently displayed based target range and angle.
j) To provide a rangefinder that automatically calculates the points in a projectile trajectory to a ranged target and determines if any obstacle is located along the trajectory.
k) To provide a display that automatically indicates that an obstacle is located along a projectile trajectory to a ranged target.
l) To provide a video game having a display that simulates ranging targets at different elevations and with different obstacles and indicating whether or not there is a clear shot.
m) To provide an iPhone application that simulates a rangefinder device and illustrates various projectile trajectories.
n) To provide a mobile smart phone application that simulates a rangefinder device and illustrates various projectile trajectories.
o) To provide a lightweight rangefinder comprising a high-resolution display and a digital camera.
p) To provide a lightweight rangefinder comprising a mobile smart phone and a range sensor combined in a housing configured to receive and connect electronically to the mobile smart phone.
q) To provide a display having virtual bow sight pins.
r) To provide a rangefinder having variable focal range (or zoom) with automatically adjusting indications of a projectile trajectory.
s) To provide an improved rangefinder which enable the user to visualize the projectile's trajectory creating confidence of a clear and safe shot.

DRAWING FIGURES

A preferred embodiment of the present invention is described in detail below with reference to the attached drawing figures, wherein.

Figure 32:
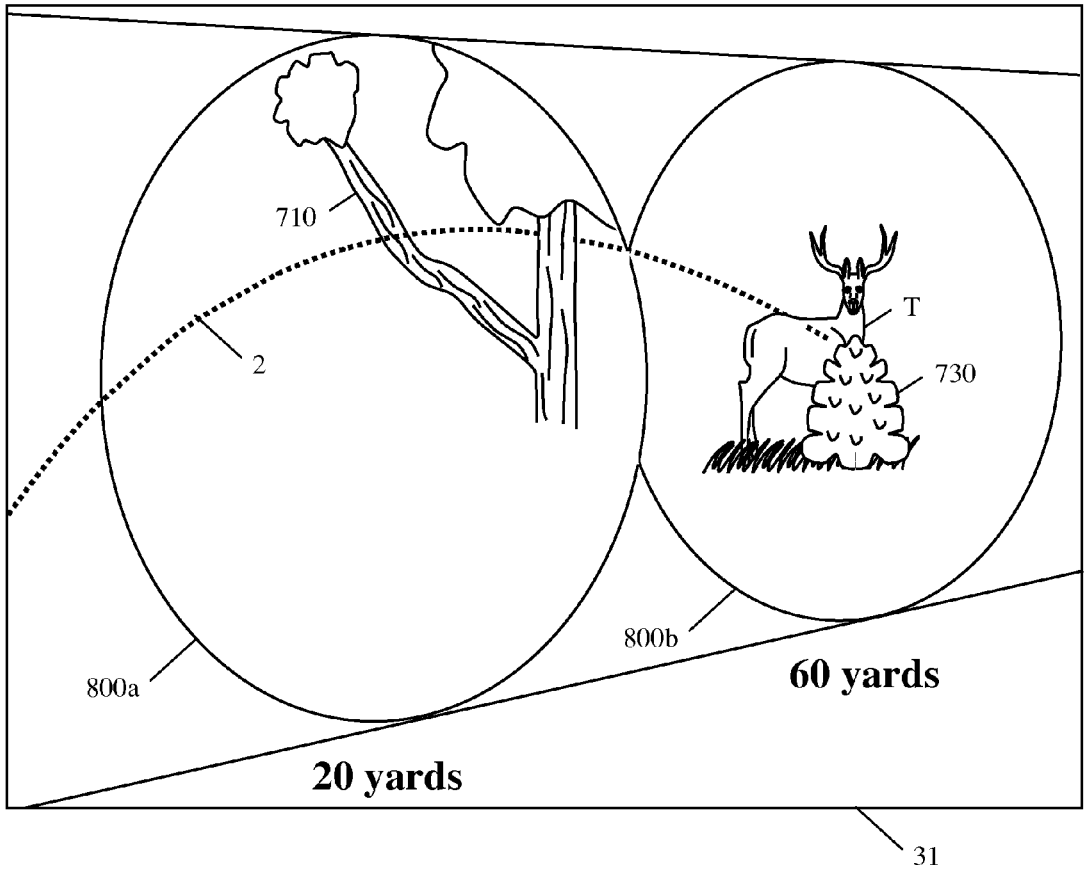
Figure 33:
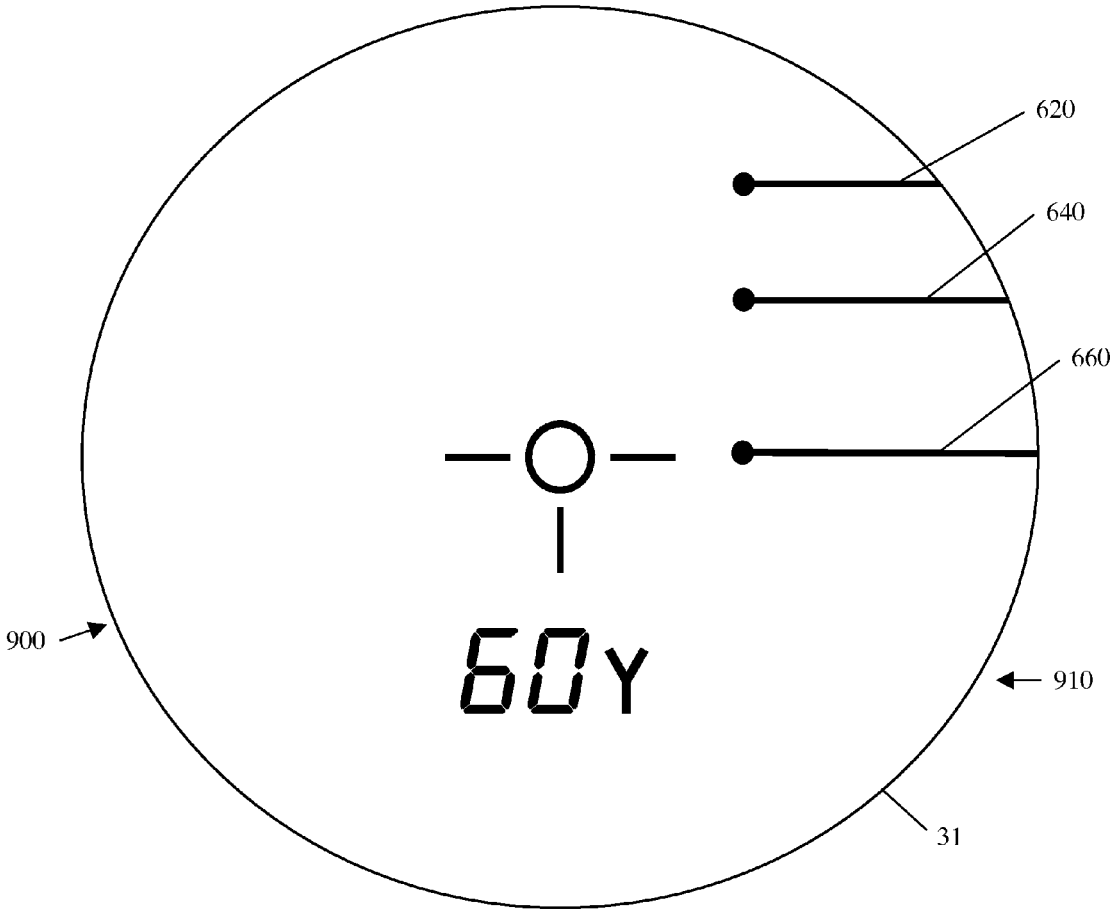

FIG. 32 illustrates an animation on a high-resolution display showing portions of an optical image which have been split into image layers which represent objects at respective ranges, the layers being skewed to represent a side perspective and the animation showing the projectile moving through image layers along the projectile trajectory; and FIG. 33 illustrates a high-resolution display showing virtual bow sight pins.

The drawing figures do not limit the present invention to the specific embodiments disclosed and described herein. The drawings are not necessarily to scale, emphasis instead being placed upon clearly illustrating the principles of the invention.

REFERENCE NUMERALS IN DRAWINGS

| | |
|---|---|
| 1 a-c | line of departure |
| 2 a-c | projectile trajectory |
| 3 a-c | line of sight |
| 4 | horizontal line |
| 10 | device |
| 11 | iPhone |
| 12 | range sensor |
| 14 | tilt sensor |
| 16 | computing element |
| 18 | memory |
| 20 | housing |
| 21 | alternate housing |
| 22 | eyepiece |
| 23 | housing slot |
| 24 | lens |
| 25 | digital camera |
| 26 | distal end |
| 27 | handle |
| 28 | proximate end |
| 30 | display |
| 31 | high-resolution display |
| 32 | inputs |
| 33 | trigger input |
| 34 a-b | display inputs |
| 35 | visor or shroud |
| 50 a-1 | frame |
| 60 | redo path |
| 62 | range target step |
| 64 | observe obstacles step |
| 66 | range obstacle step |
| 68 | more obstacles decision |
| 70 | confirm clear shot step |
| 72 | determine range step |
| 74 | determine angle step |
| 76 | calculate trajectory step |

-continued

| | |
|---|---|
| 78 | scan trajectory path step |
| 80 | obstacle-in-path decision |
| 82 | yes path |
| 84 | warn not clear step |
| 86 | no path |
| 88 | indicate clear shot step |
| 100 | archer or user |
| 102 | bow |
| 104 | arrow |
| 110 | bow sight |
| 120 | bow string sight |
| 180 | paper target |
| 182 | twenty-yard mark |
| 184 | forty-yard mark |
| 220 | twenty-yard pin |
| 240 | forty-yard pin |
| 260 | sixty-yard pin |
| 320 | twenty-yard line |
| 340 | forty-yard line |
| 420 | twenty-yard projection |
| 440 | forty-yard projection |
| 620 | virtual twenty-yard pin |
| 640 | virtual forty-yard pin |
| 660 | virtual sixty-yard pin |
| 700 | obstacles |
| 710 | branch |
| 720 | bald eagle |
| 730 | bush |
| 800 a-b | image layer |
| 810 | image highlight |
| 900 | cross hairs |
| 910 | distance indicator |
| 920 | twenty-yard indicator |
| 930 | (selectable) path indicators |
| 940 | forty-yard indicator |
| 950 | clear shot indicator |
| 960 | don't shoot indicator |
| 970 | not clear indicator |
| 980 | maximum indicator |
| 990 | angle and second range indicator |
| 992 | bow mode indicator |
| 994 | rifle mode indicator |
| 996 | trajectory mode indicator |
| 998 | ring-of-fire indicator |
| P a-c,$_{0,20,40}$ | point |
| θ a-c,$_{20-40}$ | angle (theta) |
| T a-c | target |
| V a-b | vertex |

DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Projectile Trajectories

Figure 7A:
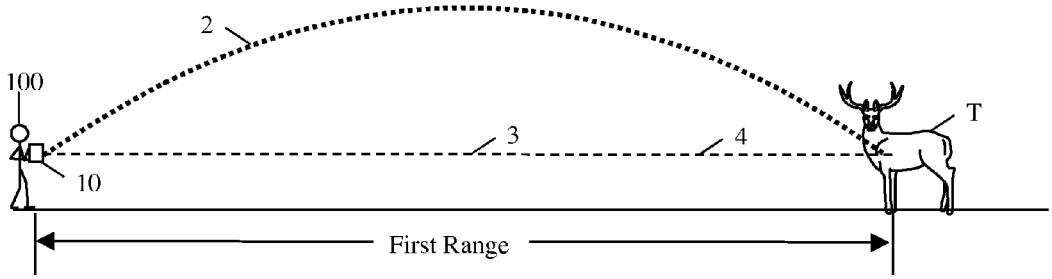
FIG. 7A is a diagram illustrating a first range to a target and an associated projectile trajectory.

FIG. 7A is a diagram illustrating a first range to a target T and an associated projectile trajectory 2. The rangefinder device 10 is show level such and the associated projectile trajectory leaves the weapon and enters the target at substantially the same true elevation (horizontal line 4).

The first range preferably represents a length of an imaginary line drawn between the device 10 and the target T, as shown in FIG. 7A, such as the number of feet, meters, yards, miles, etc., directly between the device 10 and the target T. Thus, the first range may correspond to a line of sight (LOS) 3 between the device 10 and the target T.

Figure 7B:
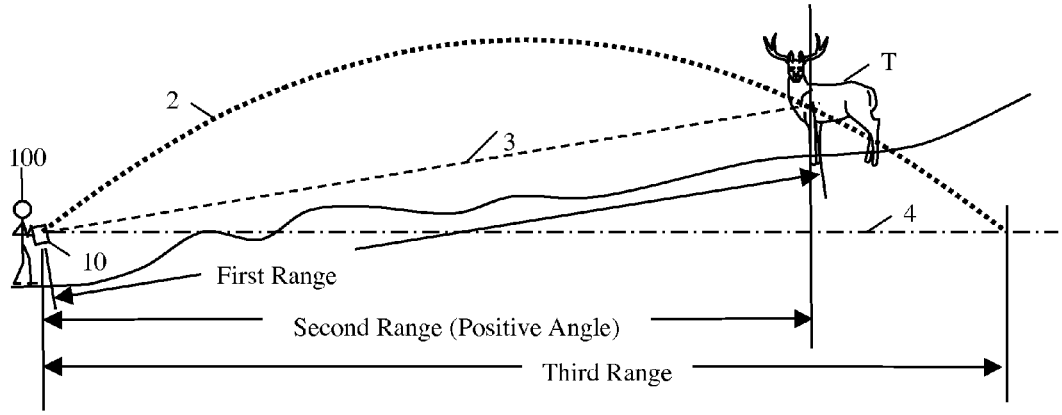
FIG. 7B is a diagram illustrating a second range and an associated projectile trajectory to the target of FIG. 7A when the target is elevated, i.e. at a positive angle.

FIG. 7B is a diagram illustrating a second range and an associated projectile trajectory 2 to the target T when the target T is elevated, i.e. is at a positive angle. The first range is the sensed range along the line of sight 3. The second range is the true horizontal distance to the target T, as measured along the horizontal line 4. A third range is the true horizontal distance, as measured along the horizontal line 4, to the projectile trajectory 2 intercept. Half of the third range is the x-axis distance to the vertex V of the projectile trajectory 2. The second range is determined by multiplying the first range by the cosine of the angle.

Figure 7C:
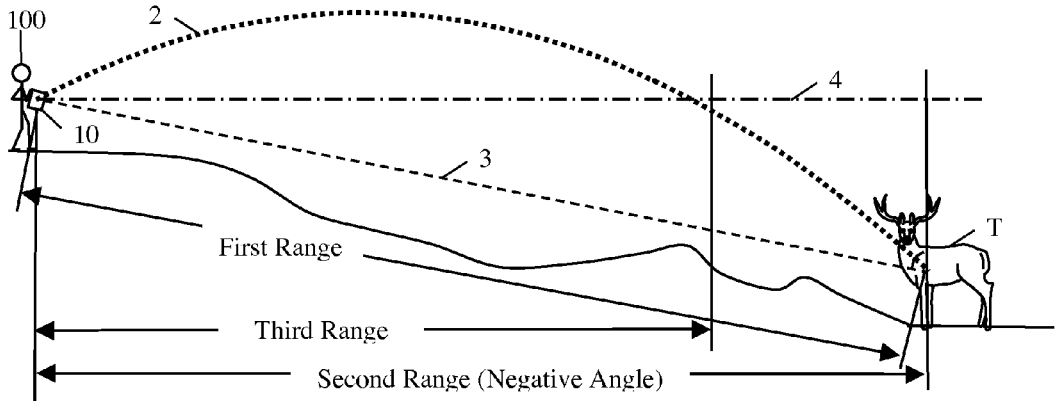
FIG. 7C is a diagram illustrating a second range and an associated projectile trajectory to the target when the target is at a lower elevation, i.e. at negative angle.

FIG. 7C is a diagram illustrating a second range and an associated projectile trajectory 2 to the target T when the target T is at a lower elevation, i.e. is at a negative angle. The first range is the sensed range along the line of sight 3. The second range is the true horizontal distance to the target T, as measured along the horizontal line 4. The third range is the true horizontal distance, as measured along the horizontal line 4, to the projectile trajectory 2 intercept. Half of the third range is the x-axis distance to the vertex V of the projectile trajectory 2.

In situations where the angle is non-zero, such as when the target T is positioned above (FIG. 7B) or below (FIG. 7C) the device 10, the parabolic movement of the projectile affects the range calculation, such that the projectile may have to travel a longer or shorter distance to reach the target T. Thus, the second range provides an accurate representation to the user of the flat-ground distance the projectile must travel to intersect the target T.

Figure 6:
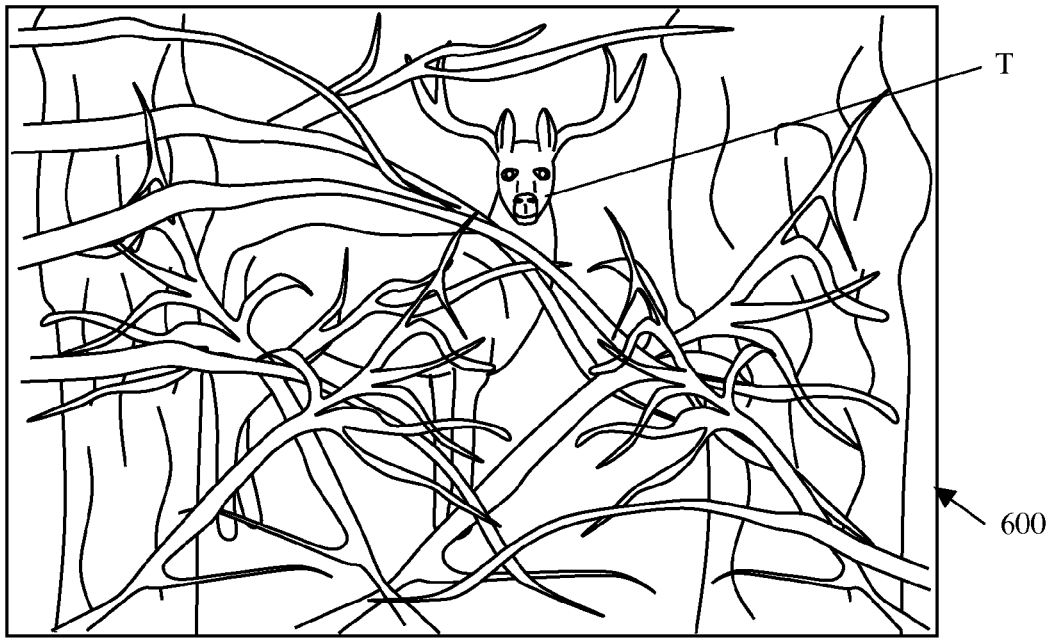
FIG. 6 illustrates a realistic target situation.
Figure 7D:
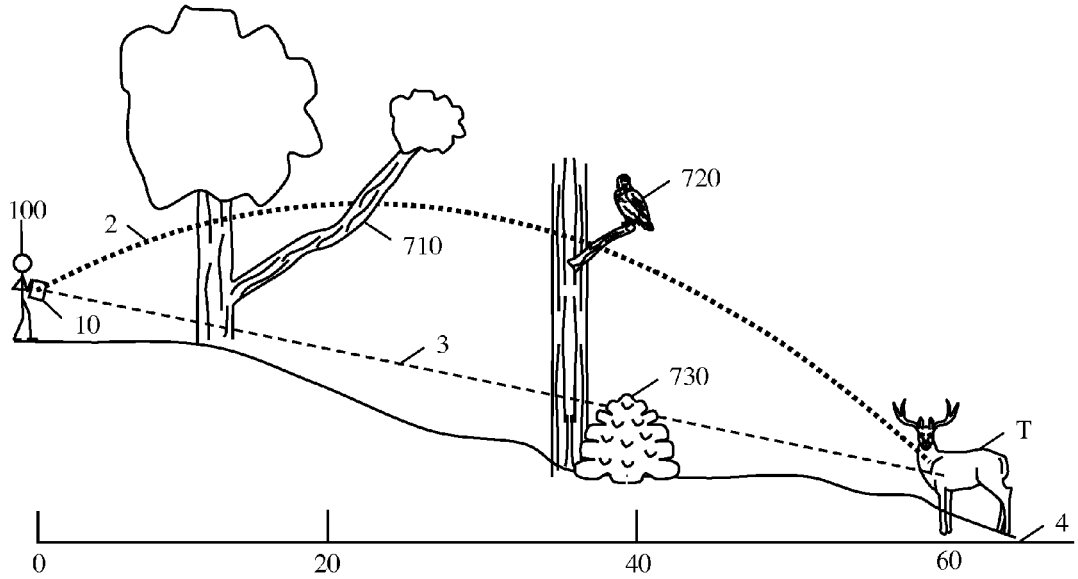
FIG. 7D is a diagram illustrating realistic target situation and an associated projectile trajectory to the target when multiple obstacles are present between the shooter and the target.

FIG. 7D is a diagram illustrating an exemplary realistic target situation (similar to the one shown in FIG. 6) and an associated projectile trajectory 2 to the target T when multiple obstacles are present between the shooter and the target. A tree with a branch 710 is show at about twenty yards. A bald eagle 720 is shown in a second tree at about forty yards. Also at forty yards is a bush 730. These obstacles conventionally would cause a lack of confidence and concern regarding the accuracy, effectiveness, safety, ethics, and legality of the anticipated shot. Because the bush 730 is in the line of sight 3, some users with little understanding of parabolic trajectories would not believe they could make the shot. Other users, who understand that the projectile trajectory is parabolic, know that the path of the trajectory goes above the line of sight 3 (see also FIG. 8). These more understanding shooters may be concerned that the projectile would hit the branch 710 or the bald eagle 720. The clear shot technology disclosed herein provides several solutions to address these concerns.

FIGS. 7A through 7C are shown with an exemplary projectile trajectory 2 based on a parabola with an A value of −0.005.

Figure 8:
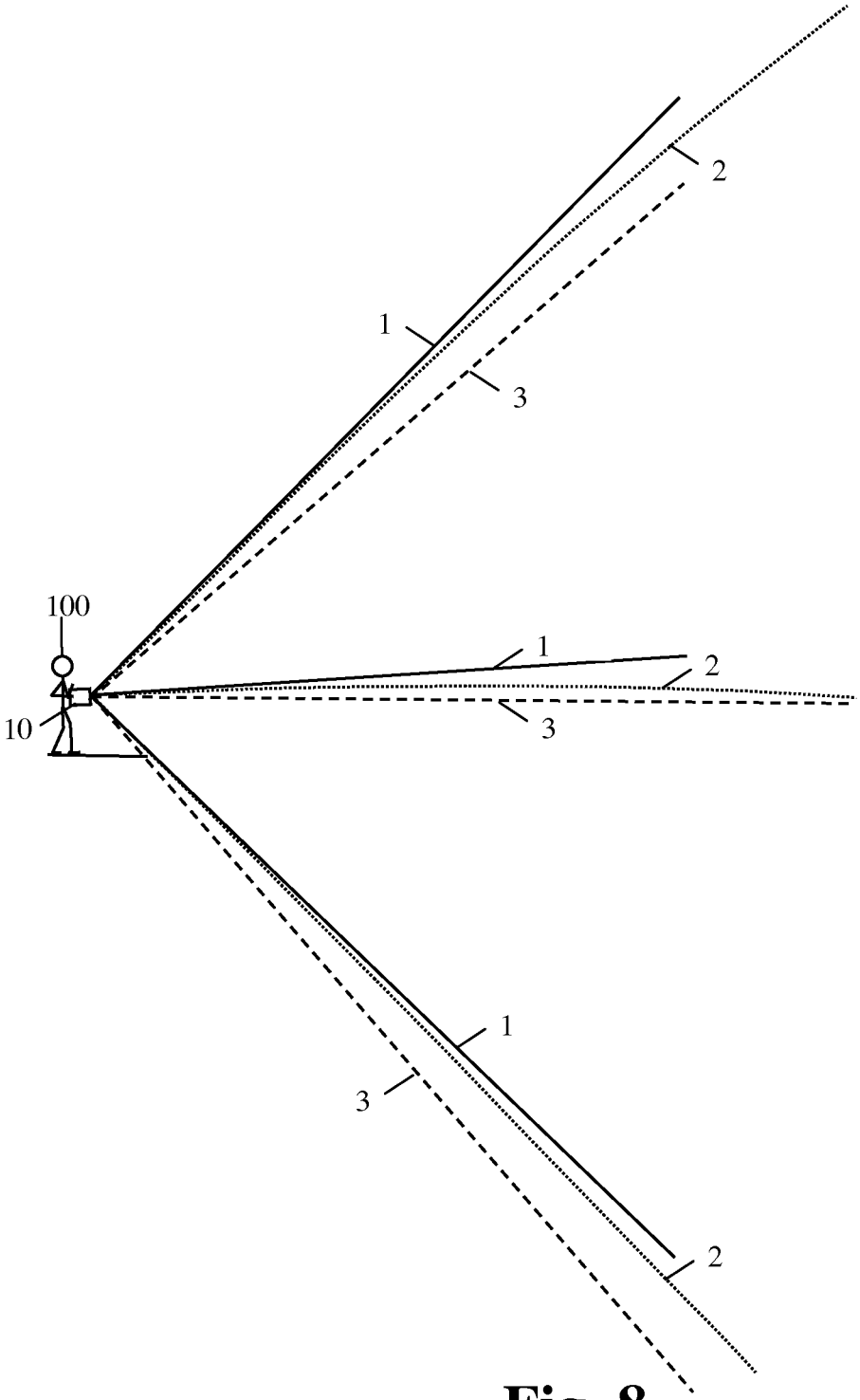
FIG. 8 is a diagram illustrating various angles and projectile trajectories relative to the device.

FIG. 8 is a diagram illustrating various angles and projectile trajectories relative to the device. The device 10 preferably comprises a tilt sensor 14. The tilt sensor 14 is operable to determine the angle to the target T from the device 10 relative to the horizontal. Thus, as shown in FIGS. 7A and 8, if the device 10 and the target T are both positioned on a flat surface having no slope, the angle would be zero. As shown in FIGS. 7B and 8, if the device 10 is positioned below the target T the slope between the device 10 and the target T is positive, the angle would be positive. Conversely, as shown in FIGS. 7C and 8, if the device 10 is positioned above the target T, such that the slope between the device 10 and the target T is negative, the angle would be negative.

Clear Shot Displays

Figure 9A:
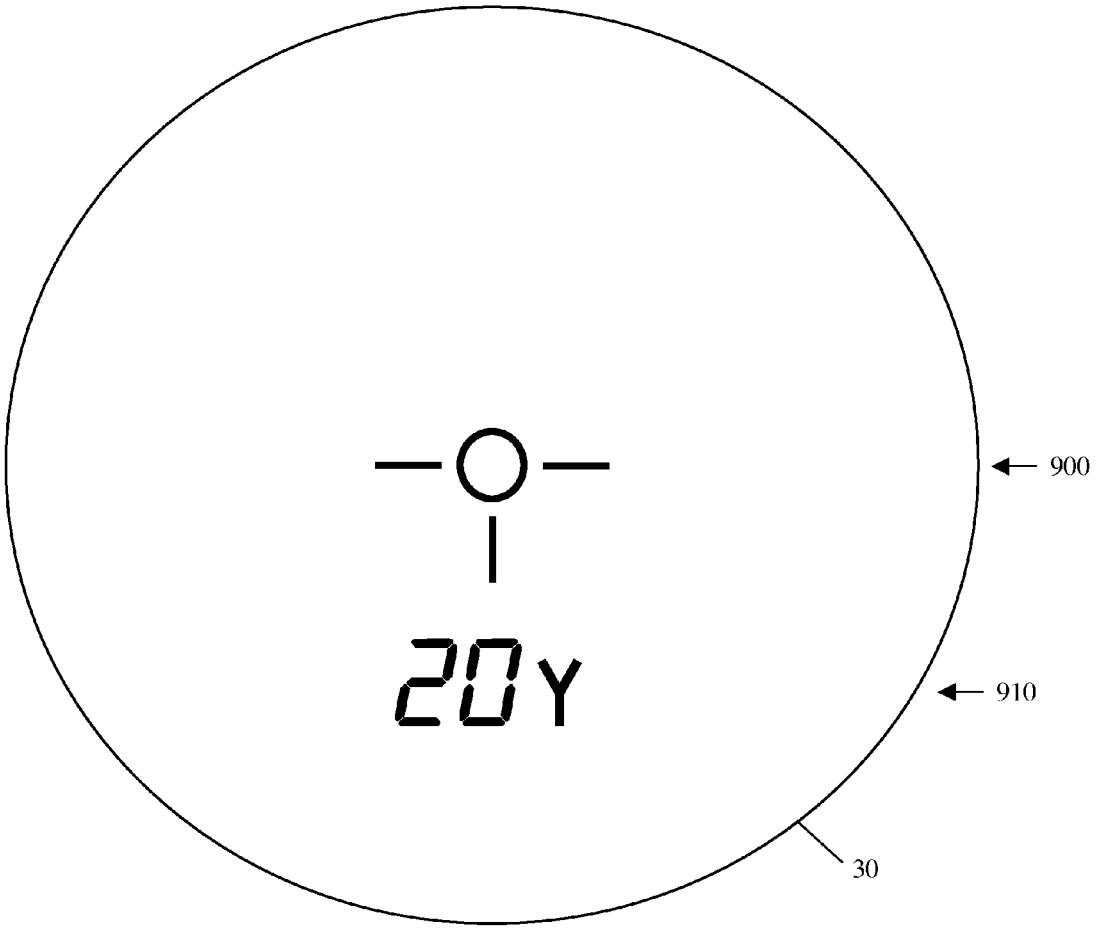
FIGS. 9A through 9C illustrate a display having dynamic path indicators, including embodiments with twenty-yard and forty-yard indicators.
Figure 9B:
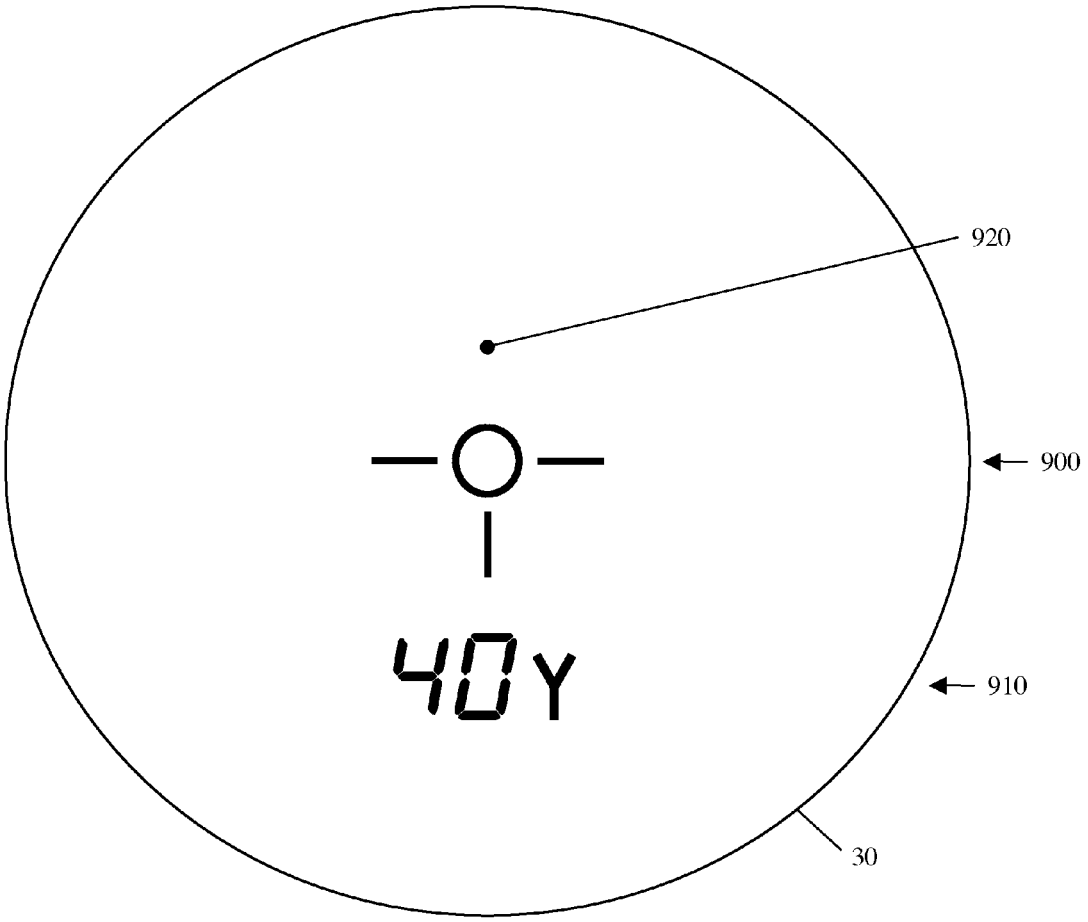
Figure 9C:
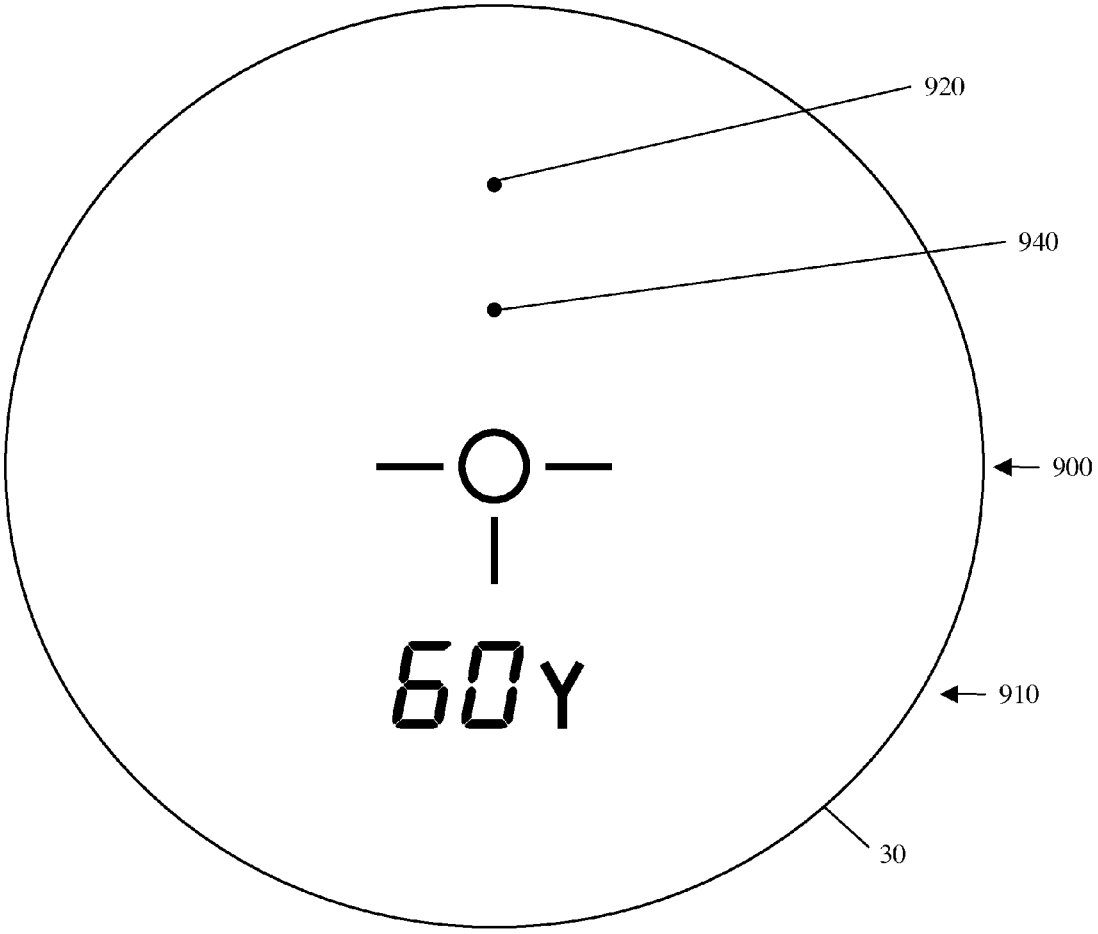

FIGS. 9A through 9C illustrate a display having dynamic path indicators 930 (or trajectory path indicators). The path indicators 930 each show a point in the trajectory path at an intermediate range. A display aspect of the present invention includes embodiments with twenty-yard indicators 920 and forty-yard indicators 940.

FIG. 9A shows the active display elements when the target T (not shown for clarity) is ranged at twenty yards. The display shows the cross hairs 900 (shown here with a center circle) which are placed on the target T. The display 30 dynamically shows that the range is twenty yards in the distance indicator 910. Because of the short distance, the projectile trajectory is close to linear so no additional indication is generally needed.

In the figures the symbols used for the various indicators are exemplary and other shapes or styles of indicators could be used. For example, the cross hairs 900 are shown with a center circle, but other styles such as intersecting lines, a solid center dot, and so forth could be used. Also the distance indicator 910 is shown having using seven segments for the digits, but other shapes of styles could be used. Positions are also exemplary.

FIG. 9B shows the active display elements when the target T (not shown for clarity) is ranged at forty yards. The display 30 shows the cross hairs 900 (show here with a center circle) which are placed on the target T. The display 30 dynamically shows that the range is forty yards in the distance indicator 910. The display 30 also dynamically illuminates a twenty-yard indicator 920. The twenty-yard indicator 920 shows a point in the projectile trajectory 2 path (e.g. FIG. 7D) at twenty yards relative to the optical image (not shown for clarity) upon which the display 30 is superimposed. The twenty-yard indicator 920 informs the user where the projectile will be at twenty yards distance.

FIG. 9C shows the active display elements when the target T (not shown for clarity) is ranged at sixty yards. The display 30 shows the cross hairs 900 (show here with a center circle) which are placed on the target T. The display 30 dynamically shows that the range is sixty yards in the distance indicator 910. The display 30 also dynamically illuminates the twenty-yard indicator 920 and a forty-yard indicator 940. The twenty-yard indicator 920 shows a point in the projectile trajectory 2 path (e.g. FIG. 7D) at twenty yards and the forty-yard indicator 940 shows a point at forty yards, both relative to the optical image upon which the display 30 is superimposed. The twenty-yard indicator 920 informs the user where the projectile will be at twenty yards distance. Further, at ranges greater than forty yards, the forty-yard indicator 940 informs the user where the projectile will be at forty yards distance.

The target ranges of twenty, forty, and sixty yards are exemplary and chosen to simplify the description of the figures. However, the range displayed on the distance indicator 910 is the actual line of sight 3 range to the target T. If the actual range were twenty-eight yards, then the distance indicator 910 would show twenty-eight yards and the twenty-yard indicator 920 would be shown closer to the cross hairs 900 than it is shown in FIG. 9B. Further, if the actual range were thirty-seven yards, then the distance indicator 910 would show thirty-seven yards and the twenty-yard indicator 920 would be shown farther from the cross hairs 900 than it is shown in FIG. 9B, but not quite as far as it is shown in FIG. 9C. This highlights the dynamic nature of the illumination of the path indicators (e.g. 920 or 940).

The examples herein generally use yards as the unit of measure. The invention is not limited to yards, but could also be set using feet, meters, kilometers, miles, and so forth.

Figure 1:
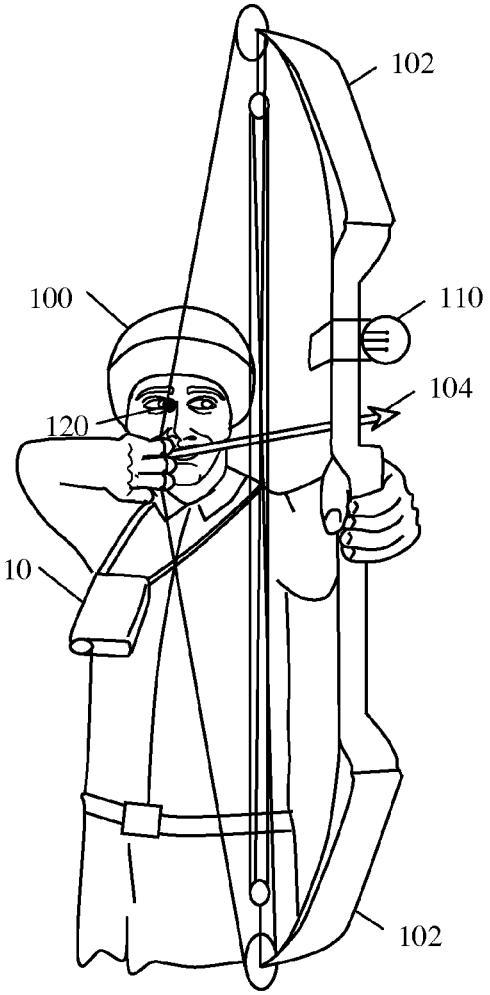
FIG. 1 illustrates an archer with a bow with a bow sight.
Figure 2:
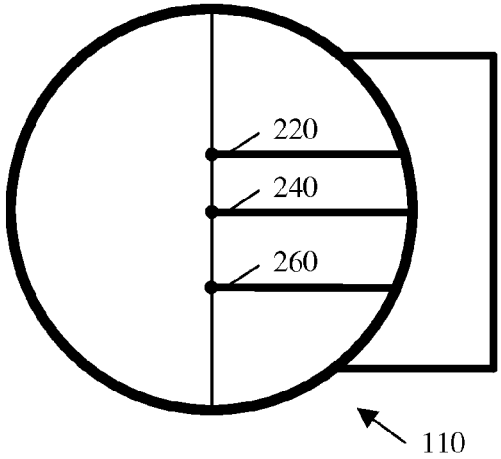
FIG. 2 illustrates exemplary details of a bow sight with multiple pins.

In some bow embodiments the display 30 or device 10 is calibrated such that the location of the twenty-yard indicator 920 matches the relative position of the twenty-yard pin 220 on the individual user's bow and bow sight 110 (see FIGS. 1 and 2).

In other bow embodiments the display 30 or device 10 is calibrated such that both locations of the twenty-yard indicator 920 and the forty-yard indicator 940 match the relative position of the twenty-yard pin 220 and forty-yard pin 240, respectively, on the individual user's bow and bow sight 110 (see FIGS. 1 and 2)

Figure 10:
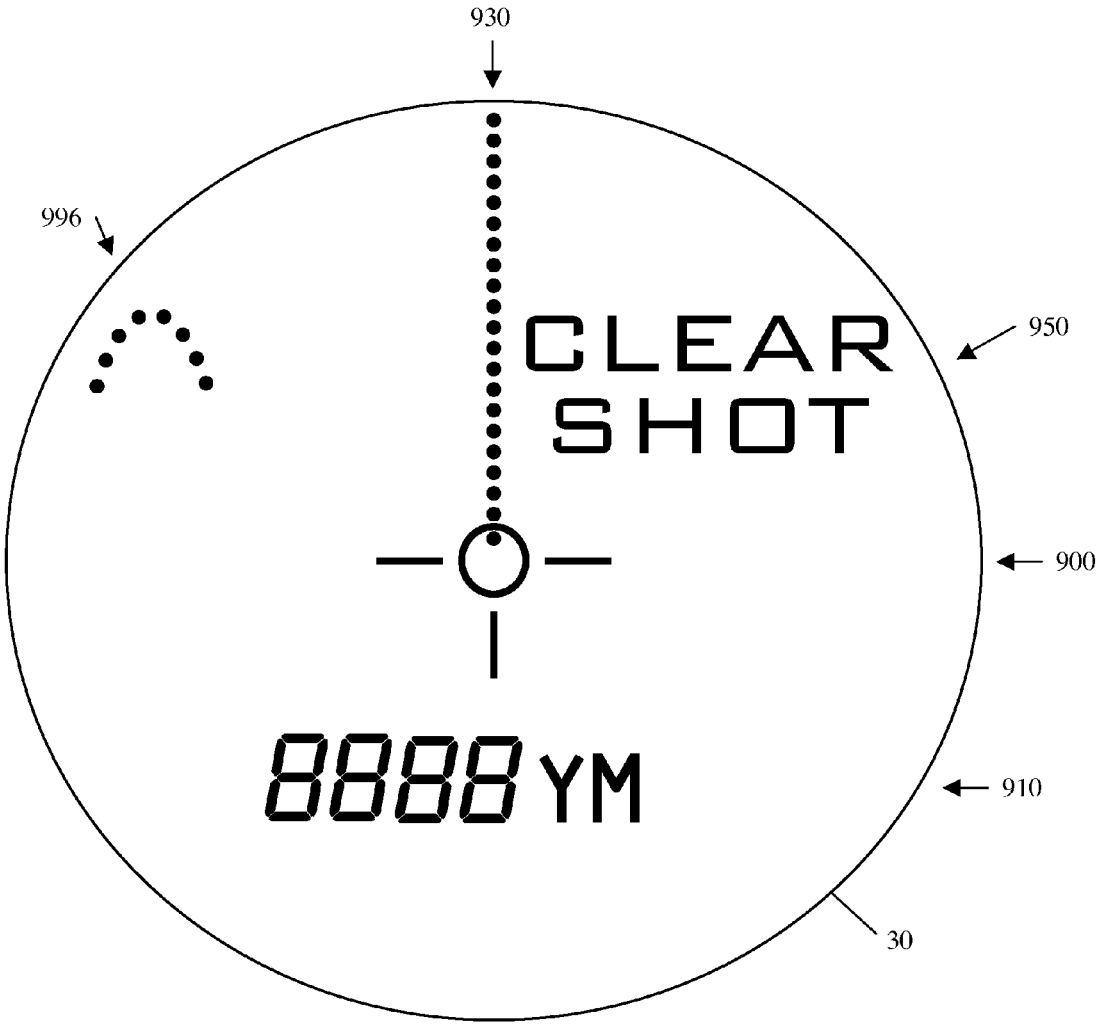
FIG. 10 shows an embodiment of a design for the display segments.

FIG. 10 shows an embodiment of a design for the display segments. An exemplary display 30 comprises segments forming cross hairs 900, distance indicator 910, a plurality of selectable path indicators 930, and an optional clear shot indicator 950. The distance indicator 910 is shown comprising a plurality of seven-segment displays that can be selectively illuminated to display any digit, and segments that indicate "Y" for yards or alternatively "M" for meters. The plurality of selectable path indicators 930 are dynamically and selectively illuminated to provide one or both of the twenty-yard indicator 920 and forty-yard indicator 940. In some embodiments, the selectable path indicators 930 could also represent a sixty-yard indicator; more granularity with an additional thirty yard and/or fifty yard indicators; or comparable meter or feet indicators. Some embodiments may contain segments that spell out the words "CLEAR SHOT" or "CLEAR" which act as a clear shot indicator 950. The segments may be shown as black, white, green, red or a plurality of colors. In some embodiments the colors and intensity of the segments may be user selectable or automatically set based on the darkness or colors of the optical image upon which the display 30 is superimposed.

Clear Shot Display Operation

Figure 11A:
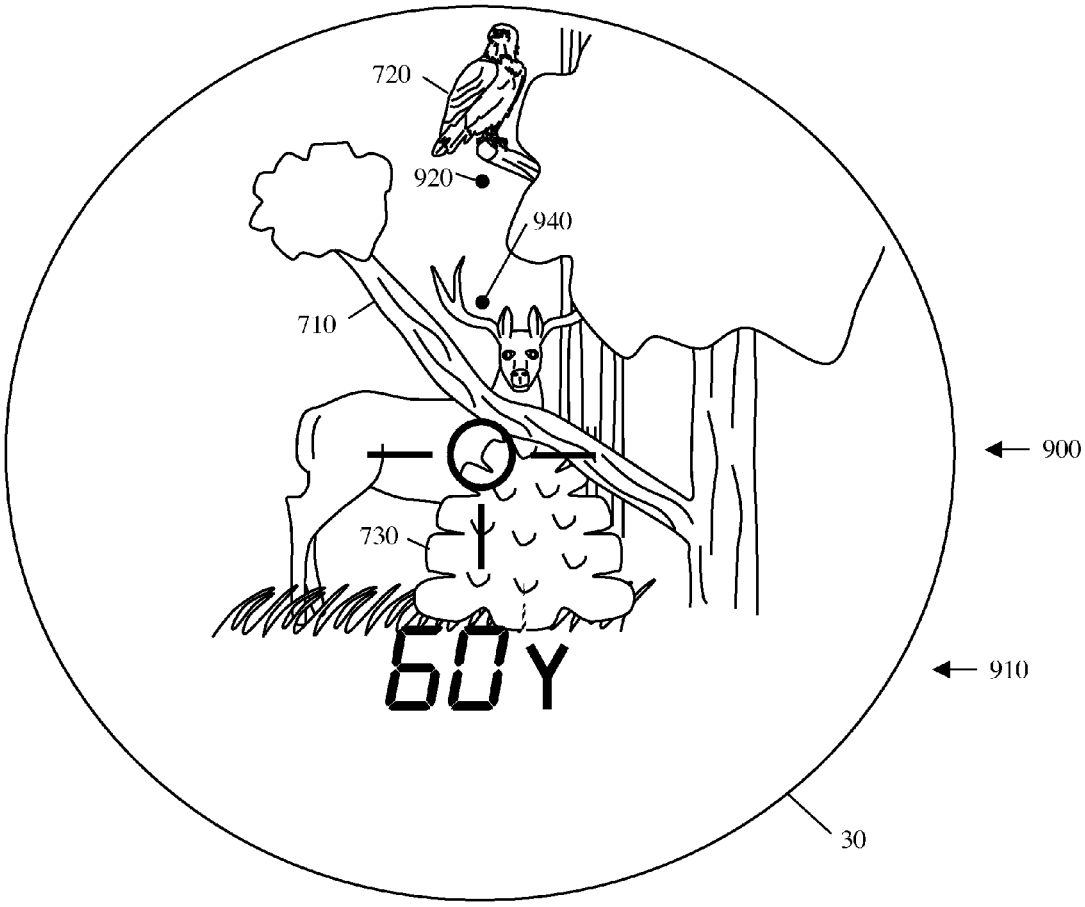
FIG. 11A is a schematic view of a target and obstacles observed while looking through the device, including a display illuminating the distance and twenty-yard and forty-yard indicators.

FIG. 11A is an exemplary schematic view of a target T and obstacles (710, 720, 730) observed while looking through the device 10, including a display illuminating the distance indicator 910, a twenty-yard indicator 920 and a forty-yard indicator 940. The appearance of the display is the same as FIG. 9C with the addition of exemplary target T and obstacles, e.g. branch 710, bald eagle 720, and bush 730. FIG. 7D shows the same set of potential obstacles and projectile trajectory 2 from the side. In this example, the deer (target T) is ranged at a line of sight 3 distance of sixty yards. Both the twenty-yard indicator 920 and forty-yard indicator 940 are shown. The user can see that both the twenty-yard indicator 920 and forty-yard indicator 940 are positioned over clear areas in the optical image. In this example, the twenty-yard indicator 920 is below the bald eagle 720 and the forty-yard indicator 940 is above the bush 730. Even though the bush 730 is in the line of sight 3 (indicated at the cross hairs 900) the projectile will pass over the bush (as shown in FIG. 7D).

Thus, the information from the display provides an indication to the user 100 that a clear shot can be taken. Further, the user 100 can lower the device 10 and pick up the weapon, for example, bow 102 and match the corresponding bow sight pins (e.g. twenty-yard pin 220 and forty-yard pin 240, respectively) to the same positions that were visualized relative to the optical image seen in the device 10.

As will be discussed in greater detail later, the user 100 could user the device 10 to find the range to the branch 710 (e.g. twenty yards) and to the bush 730 (e.g. forty yards) and to the bald eagle 720 (e.g. forty yards). This would provide further confidence that a safe, effective, ethical, and legal shot could be taken.

If the range sensor 12 is a laser and is blocked by the bush 730, the user 100 can find the range of another part of the target (such as the hind quarters), the ground, or a nearby object such a rock or tree, and use the twenty-yard indicator 920 and forty-yard indicator 940 to visualize the elevation of the other potential obstacles, to reach a determination that the shot would be clear.

Figure 11B:
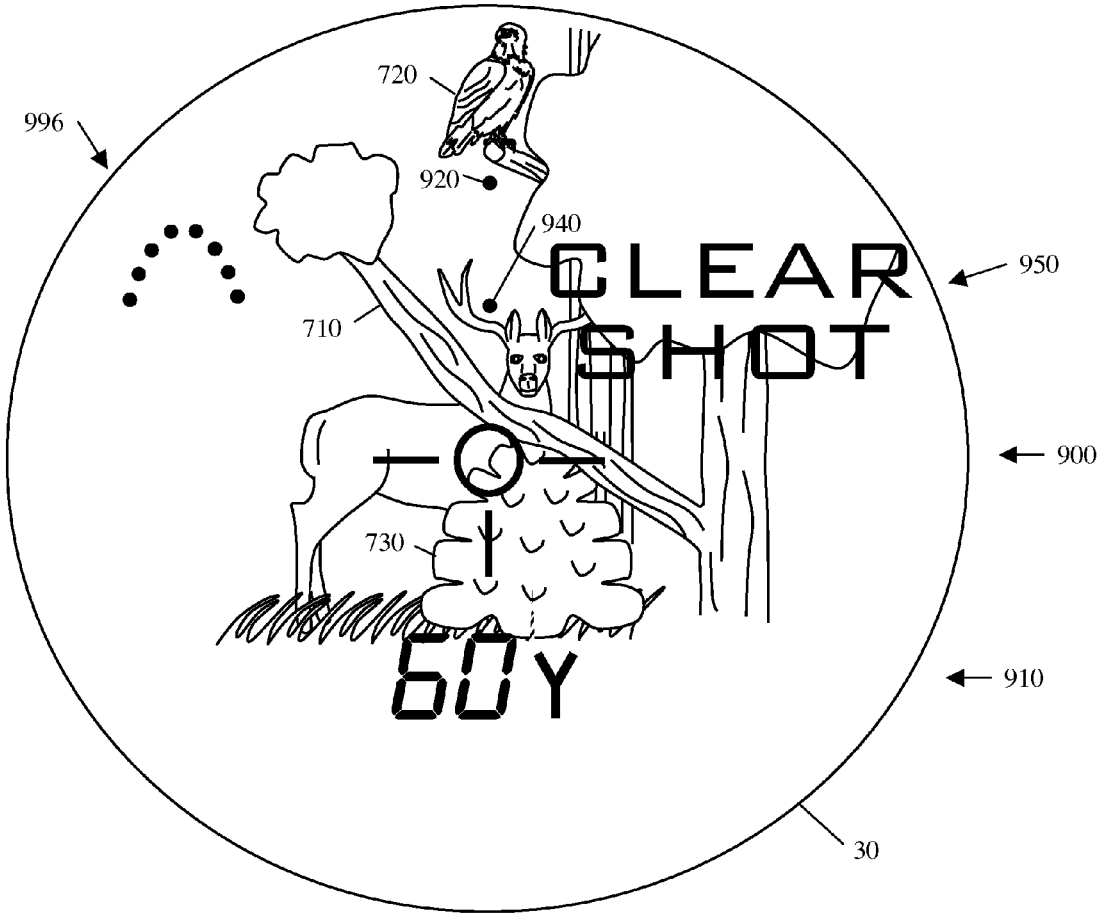
FIG. 11B is a schematic view of a target and obstacles observed while looking through the device, including a display illuminating the distance and twenty-yard and forty-yard indicators, and a clear shot indicator.

FIG. 11B is exemplary schematic view of a target T and obstacles (710, 720, 730) observed while looking through the device 10, including another embodiment of a display illuminating the distance indicator 910, a twenty-yard indicator 920, a forty-yard indicator 940, and a clear shot indicator 950. The situation and appearance of the display is the same as FIG. 11B with the addition of an exemplary clear shot indicator 950, shown in this embodiment as the words "CLEAR SHOT." In this embodiment, the device 10 has automatically determined that there are no obstacles at any point in the projectile trajectory 2 path (see, for example, FIG. 7D)

Thus, the information from the display provides an explicit indication to the user 100 that a clear shot can be taken. Further, the user 100 can lower the device 10 and pick up the weapon, for example, bow 102 and match the corresponding bow sight pins (e.g. twenty-yard pin 220 and forty-yard pin 240, respectively) to the same positions that were visualized relative to the optical image seen in the device 10.

Figure 11C:
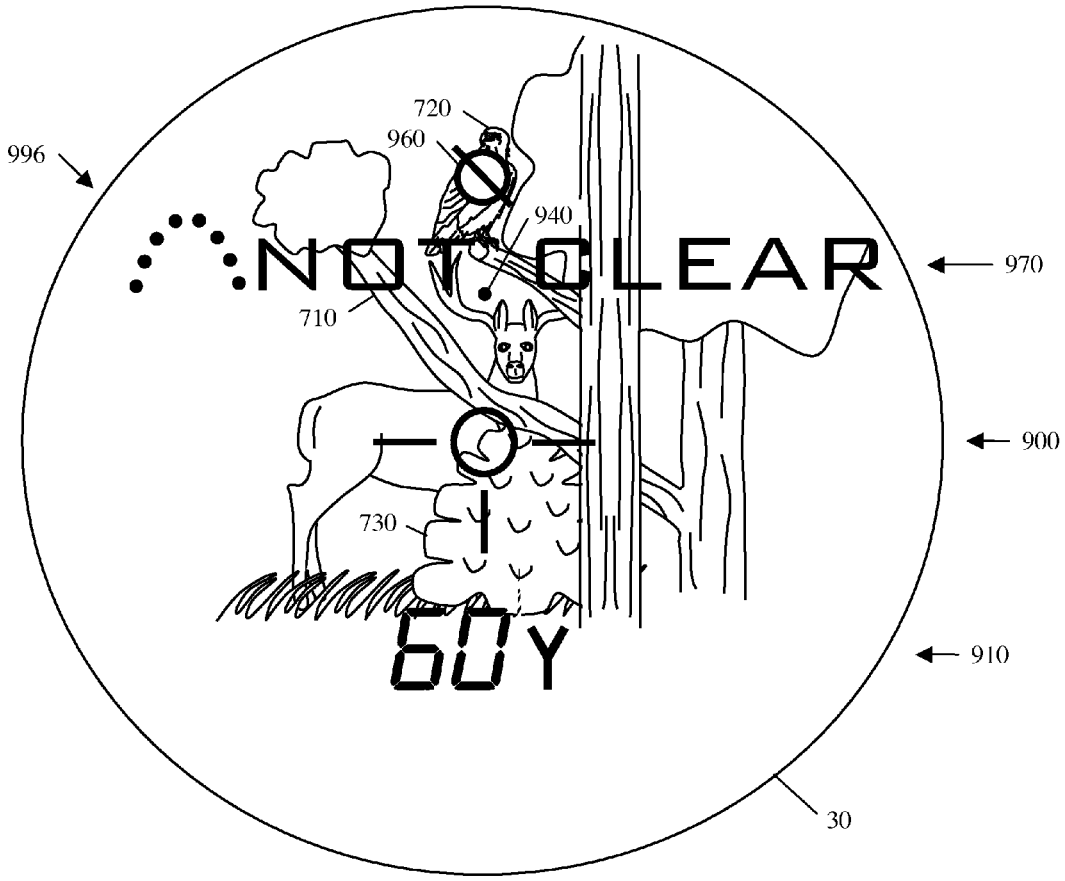
FIG. 11C is a schematic view of a target and obstacles observed while looking through the device, including a display illuminating the distance and twenty-yard and forty-yard indicators, and not clear indicators.

FIG. 11C is exemplary schematic view of a target T and obstacles (710, 720, 730) observed while looking through the device 10, including yet another embodiment of a display illuminating the distance indicator 910, a twenty-yard indicator 920, a forty-yard indicator 940, an optional don't shoot indicator 960, and an alternative not clear indicator 970. The situation is similar to the situation of FIGS. 7D, 11A and 11B; however in this example, the bald eagle 720 located at twenty yards and is located in projectile trajectory. The appearance of the display is similar to as FIG. 11B except that the clear shot indicator 950 is not illuminated but instead the not clear indicator 970, in this embodiment show as the words "NOT CLEAR," is illuminated. In one embodiment, the don't shoot indicator 960, in this embodiment shown as a circle with a diagonal line through it, is superimposed over the obstacle, e.g. bald eagle 720, in the place of the twenty-yard indicator 920. In these embodiments, the device 10 has automatically determined that there is an obstacle in the projectile trajectory 2 path. Thus, the information from the display provides an explicit indication to the user 100 that a clear shot cannot be taken.

Figure 11D:
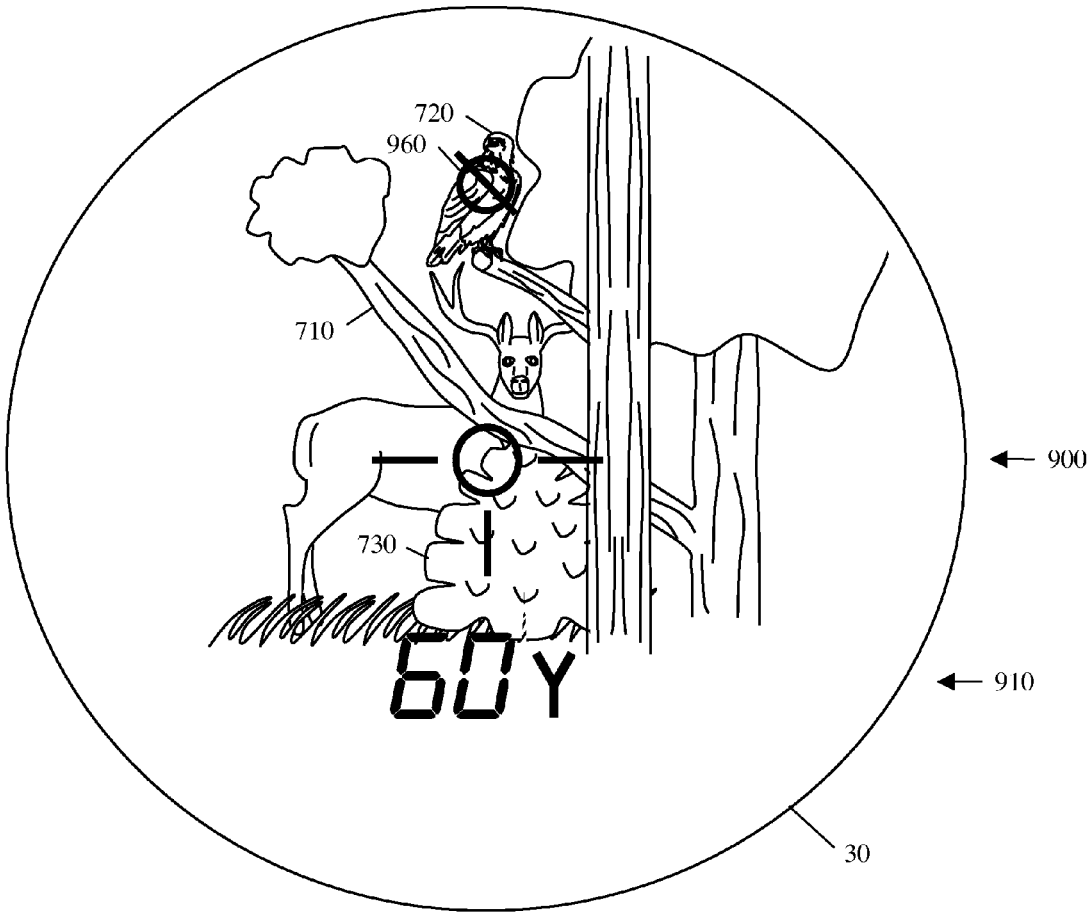
FIG. 11D is a schematic view of a target and obstacles observed while looking through the device, including a display indicating the range and an exemplary obstacle with a not clear indicator.

FIG. 11D is exemplary schematic view of a target T and obstacles (710, 720, 730) observed while looking through the device 10, including a simpler embodiment of a display illuminating the distance indicator 910, and one or more don't shoot indicators 960. The situation is similar to the situation of FIG. 11C where the bald eagle 720 located at twenty yards and is located in projectile trajectory. However, in this embodiment when the projectile trajectory 2 is not clear, a don't shoot indicator 960 is superimposed over the obstacle, e.g. bald eagle 720. If more than one obstacle is in the projectile trajectory 2, multiple don't shoot indicators 960 may be displayed. In this embodiment when the path is not clear, the trajectory indicators, such as the twenty-yard indicator 920 and/or the forty-yard indicator 940 are not illuminated. In this simpler embodiment, the device 10 has automatically determined that there are one or more obstacles in the projectile trajectory 2 path. Thus, the information from the display provides an explicit indication to the user 100 that a clear shot cannot be taken and the problematic obstacle is indicated by a corresponding don't shoot indicator 960.

The user can change the position of the device 10 until the don't shoot indicator 960 is cleared and the clear shot indicators return (such as shown in FIG. 11A or 11B).

Methods for Determining and Displaying a Clear Shot

Some method aspects of the present invention will be explained with specific reference to FIGS. 12, 13A, and 13B.

Figure 12:
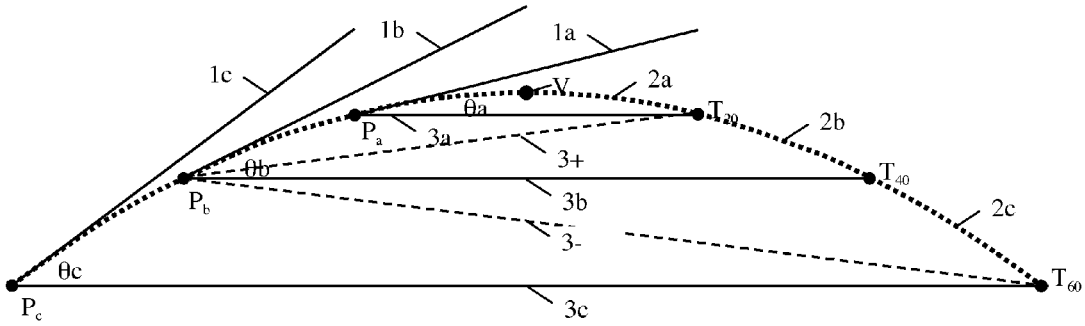
FIG. 12 illustrates an exemplary projectile trajectory for targets at three different distances.

FIG. 12 illustrates an exemplary projectile trajectory for targets at three different distances. As discussed above, it is well known that a projectile trajectory follows a parabolic or ballistic trajectory. The parabolic curve is generally determined by the force of gravity on the projectile. Further, air drag reduces the projectiles velocity and affects the curve. As disclosed in the patent referenced above, the information to accurately identify the trajectory for a given weapon and projectile combination may be entered in the device 10 by a user during configuration or may be looked up using a means of a database or table lookup. Additionally, as will be discussed later the device 10 can be calibrated to match the specific trajectory of a individual's bow and bow sight which has been calibrated a specific individual to match their individual strength, form, and bow handling.

Once the trajectory is known for a particular projectile, the curve is represented in the device by a mathematical formula, such that any point along the projectile trajectory may be calculated. FIG. 12 shows three exemplary points, namely point Pa, point Pb, and point Pc. A shot taken at angle A (shown as theta a) along line of departure 1*a* will travel along projectile trajectory segment 2*a* until it intercepts target Ta (shown as $T_{20}$) at a horizontal distance of twenty yards along line of sight 3*a*. A shot taken at angle B (shown as theta b) along line of departure 1*b* will travel along projectile trajectory segment 2*b* until it intercepts target Tb (shown as $T_{40}$) at a horizontal distance of forty yards along line of sight 3*b*. A shot taken at angle C (shown a theta c) along line of departure 1*c* will travel along projectile trajectory segment 2*c* until it intercepts target Tc (shown as $T_{60}$) at a horizontal distance of sixty yards along line of sight 3*c*.

When FIGS. 7B and 7C are considered, FIG. 12 also reveals that a shot could be taken from point Pb and intersect target Ta (shown as $T_{20}$) at a horizontal distance (second range) of thirty yards and a positive angle line of sight 3+. Further, a shot could be taken from point B and intersect target Tc (shown as $T_{60}$) at a horizontal distance (second range) of fifty yards and a negative angle line of sight 3–. According, once the projectile trajectory is known any angle of line of sight 3 and sensed range (first range) can be used to calculate the horizontal distance (second range) to any point in the projectile trajectory.

Figure 13A:
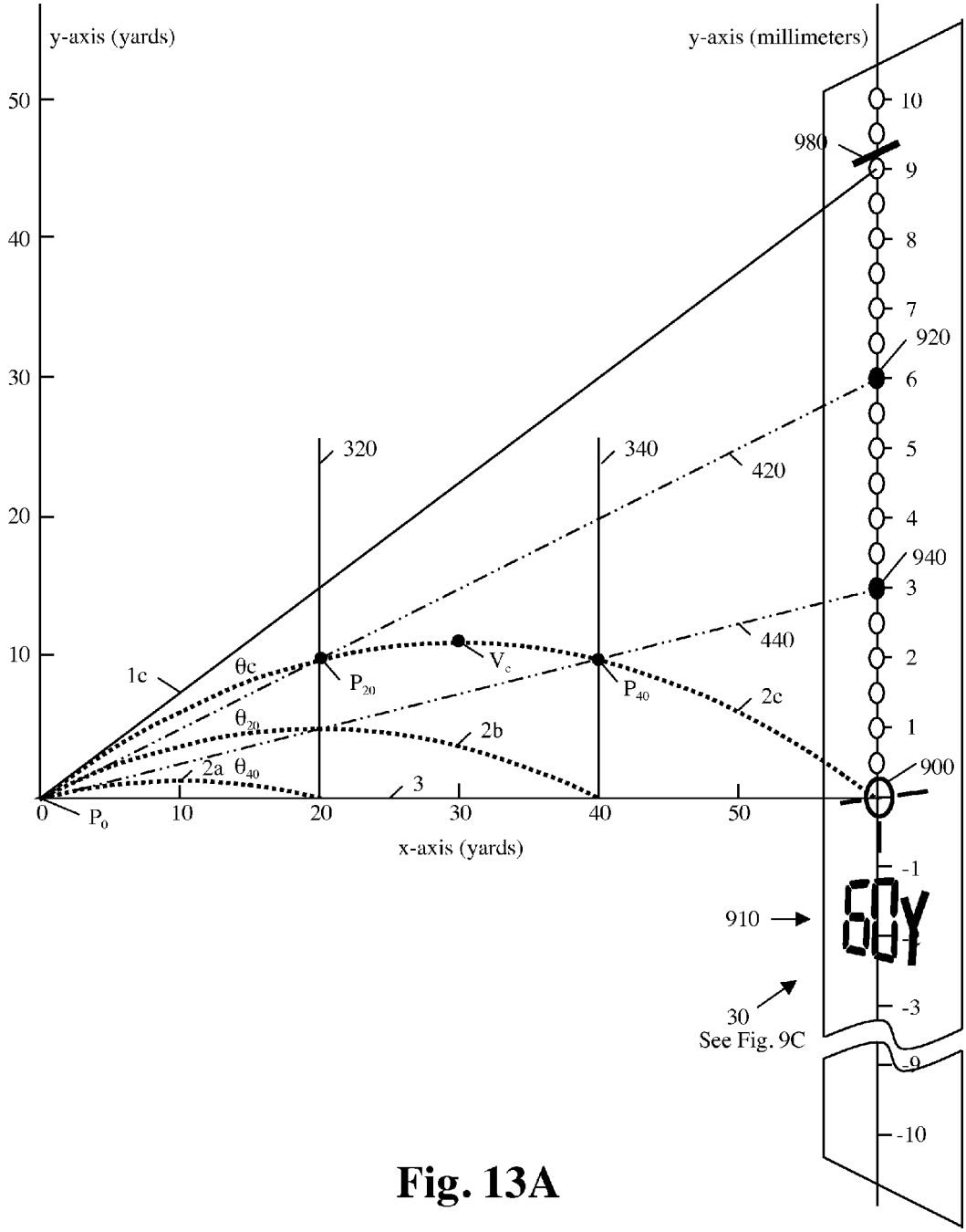
FIG. 13A illustrates how the exemplary trajectories and angles of FIG. 12 are used to dynamically determine the display locations for twenty-yard and forty-yard indicators.

FIG. 13A illustrates how the exemplary trajectories and angles of FIG. 12 are used to dynamically determine the display locations for the path indicators 930, such as the twenty-yard indicator 920 and/or the forty-yard indicator 940.

FIG. 13A illustrates the projectile trajectory segments 2*a*, 2*b*, and 2*c*, respectively, from FIG. 12 transposed such that the departure points are aligned at zero on the range scale (x-axis), common point $P_0$. The corresponding lines of departure 1*a*, 1*b*, and 1*c*, respectively, are also transposed such that the departure points are aligned at point $P_0$. The horizontal line of sight 3 is the now the same for all three trajectories and becomes the x-axis. In this example, the x-axis has unit of yards. The y-axis on the left also has units of yards.

Line of departure 1*c* is a parabolic tangent of the projectile trajectory 2*c* that intersects the parabola at point $P_0$ at (0, 0).

FIG. 13A also shows dashed lines, twenty-yard projection 420 and forty-yard projection 440, showing the angle from the point of departure to the intersection of a vertical twenty-yard line 320 (at point $P_{20}$) and a forty-yard line 340 (at point $P_{40}$), respectively. Further, superimposed on the curves and angles of FIG. 13A is a perspective view of a section of the display 30 showing how the location of the path indicators are determined. The cross hairs 900 are shown where the line of sight 3 is projected on the display 30. The distance indicator 910 shows the sensed range, for example, of sixty yards. One of the plurality of selectable path indicators 930 (FIG. 10) is illuminated based on where the twenty-yard projection 420 line corresponds to the relative position on the display 30. Another of the plurality of selectable path indicators 930 (FIG. 10) is illuminated based on where the forty-yard projection 440 line corresponds to the relative position on the display 30. The y-axis on the right relates to the scale of the display 30 also has units of millimeters.

The projectile trajectory 2 will vary based on many parameters related to the weapon, such a bow type, the projectile, the user, and the range and angle to the target. In the example shown in FIG. 13A, the projectile trajectory 2*c* has a vertex Vc at (30, 11.25), $P_{20}$ at (20,10), and $P_{40}$ at (40,10). The origin, point $P_0$ is at (0,0). The line of departure 1*c* intersects the twenty-yard line 320 at (20, 15). In this example, angle θc is 36.9 degrees, angle $\theta_{20}$ is 26.6 degrees, and angle $\theta_{40}$ is 14.0 degrees. The exemplary conversion factor from the real world (left y-axis) to the scale of the display 30 chip (right y-axis) is 5 yards=1 millimeter. Once angle $\theta_{20}$ and angle $\theta_{40}$ calculated, the corresponding one of the plurality of selectable path indicators 930 are turned on for the twenty-yard indicator 920 and the forty-yard indicator 940, respectively (e.g. at 6 millimeters and 3 millimeters, respectively).

The line of departure 1*c* is a parabolic tangent of the projectile trajectory 2*c* that intersects the parabola at point $P_0$ at (0, 0). The slope of the parabolic tangent 1*c*, or $m_c$, is found by calculation the tangent, namely opposite over adjacent, in this example 45/60 or 0.75. The equation for line of departure 1*c* is y=m*x+b, in this example, y=0.75x. The angle of each line is found by using the inverse tangent (arctan or $\tan^{-1}$), function. In this example, θc=arctan (0.75)=36.9 degrees.

The tangent of the twenty-yard projection 420 line is 30/60 or 0.5 and angle is arctan(0.5) or 26.6 degrees. The tangent of the forty-yard projection 440 line is 15/60 or 0.25 and angle is arctan(0.25) or 14.0 degrees.

In this example, the values for the parabolic equations for projectile trajectory 2*c* are:

$$h=30$$

$$k=11.25$$

$$A=-0.0125$$

$$B=0.75$$

$$C=0$$

The standard form equation is:

$$y=-0.0125x^2+0.75x$$

The vertex form equation is:

$$y=0.0125(x-30)^2+11.25$$

The true aim point is 45 yards above the target or 9 millimeters on the display (right y-axis). The maximum indicator 980 is illuminated (shown just above the calculated point, but would be more precisely displayed on a high-resolution display 31 embodiment).

Figure 13B:
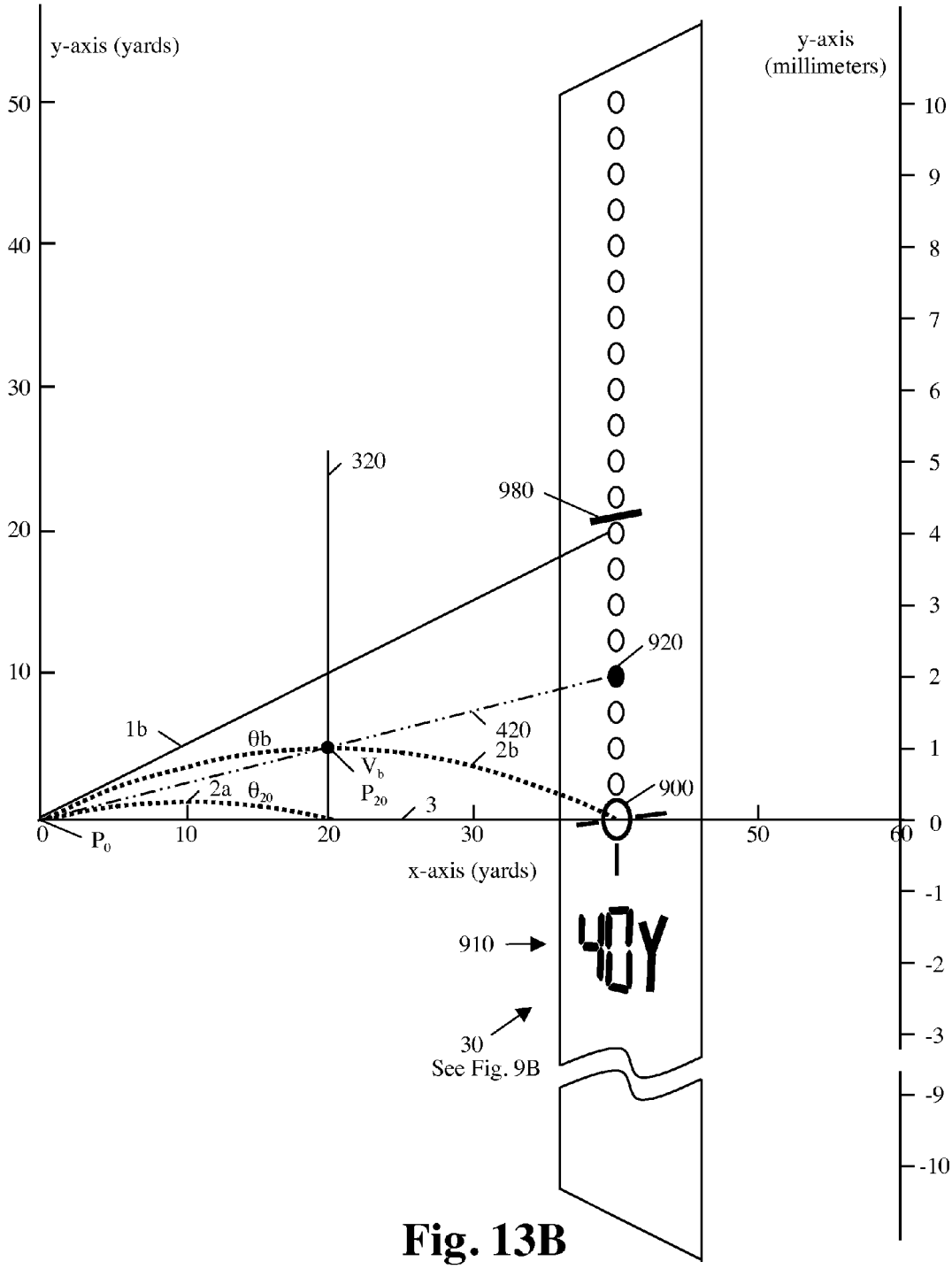
FIG. 13B illustrates how the exemplary trajectories and angles of FIG. 12 are used to dynamically determine the display location for a single twenty-yard indicator.

FIG. 13B illustrates the projectile trajectory segments 2*a* and 2*b*, respectively, from FIG. 12 transposed such that the departure points are aligned at zero on the range scale (x-axis). The corresponding lines of departure 1*a* and 1*b*, respectively, are also transposed such that the departure points are aligned at $P_0$. The horizontal line of sight 3 is the now the same for both trajectories and becomes the x-axis.

FIG. 13B also shows a dashed line, a twenty-yard projection 420, showing the angle from the point of departure to the intersection of a vertical twenty-yard line 320 (at point $P_{20}$). As in FIG. 13A, superimposed on the curves and angles of FIG. 13B is a perspective view of a section of the display 30 showing how the location of a single twenty-yard indicator 920 is determined. The cross hairs 900 are shown where the line of sight 3 is projected on the display 30. The distance indicator 910 shows the sensed range, for example, of forty yards. One of the plurality of selectable path indicators 930 (FIG. 10) is illuminated based on where the twenty-yard projection 420 line corresponds to the relative position on the display 30.

Focusing now on a comparison of the two sections of the display 30 shown is FIGS. 13A and 13B. Both indicate that one of the plurality of selectable path indicators 930 (FIG. 10) is illuminated based on where the twenty-yard projection 420 line hits the display. More specifically, the computing element 16 (FIG. 3) uses a mathematical model representation of the curves, angles and lines shown in FIGS. 13A and/or 13B in memory 18, calculates the relative distance from the cross hairs 900 to the computed point that the twenty-yard projection 420 would appear on the computed representation (or model), and uses the relative distance to selectively illuminate the appropriate one of the plurality of selectable path indicators 930. In FIG. 13A, the illuminated path indicator 930 is near the top of the display 30 (see twenty-yard indicator 920). In contrast, in FIG. 13B the target is closer, such that the illuminated path indicator 930 is near the cross hairs 900 of the display 30 (see twenty-yard indicator 920). Thus, an aspect of the invention is that the path indicators 930, such as the twenty-yard indicator 920, are displayed dynamically based on the projectile trajectory 2 and sensed range, and correspond to the relative distance above of the target T and obstacles 700 upon which the display is superimposed. Further, in bow mode, the path indicators correspond the individual user's bow 102 and bow sight 110 (FIG. 1).

Rangefinder Device

Figure 3:
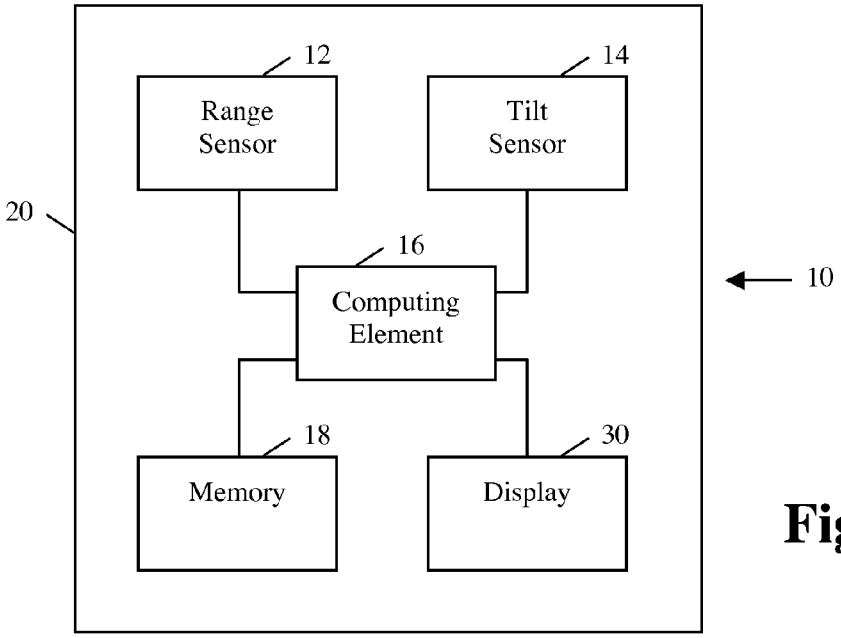
FIG. 3 is a block diagram of a rangefinder device.
Figure 4:
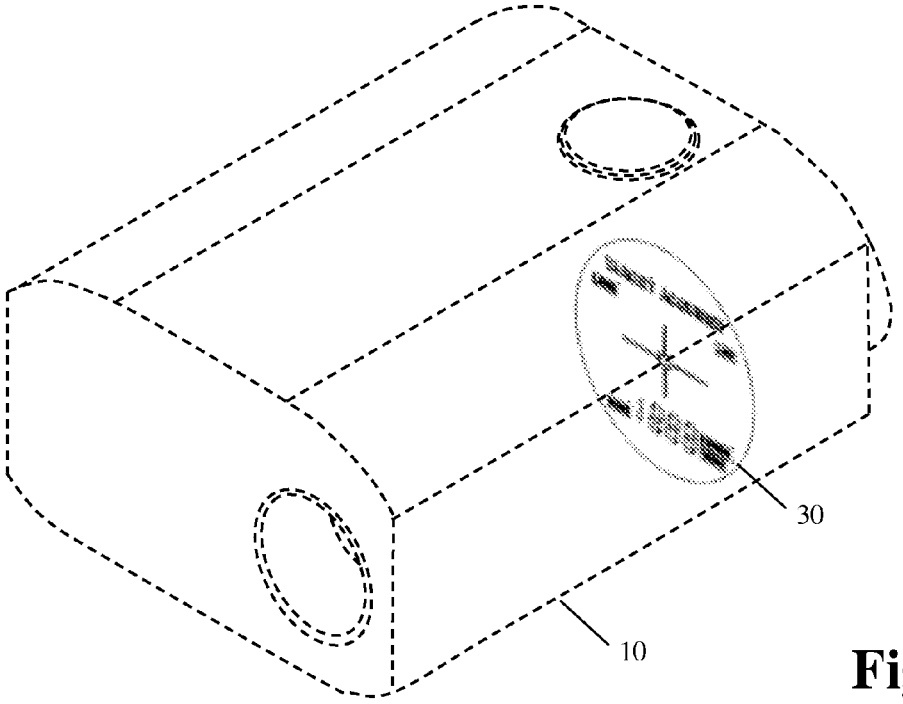
FIG. 4 shows the appearance of an exemplary display within a device.
Figure 5:
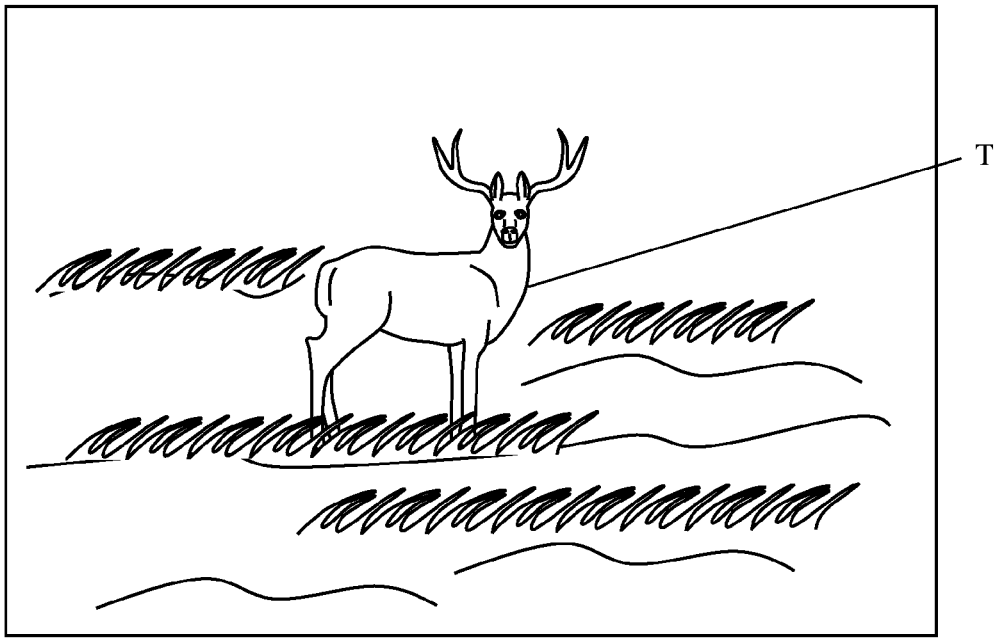
FIG. 5 illustrates an ideal target situation.
Figure 14:
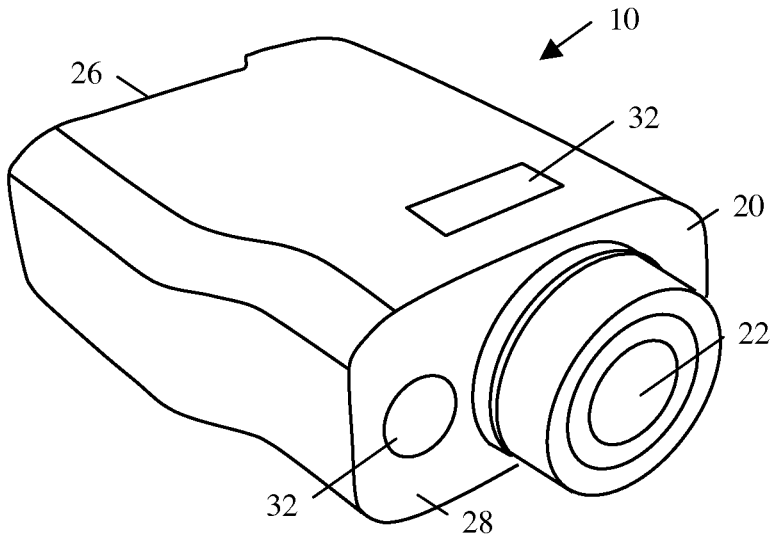
FIG. 14 is a rear perspective view of an exemplary rangefinder device.
Figure 15:
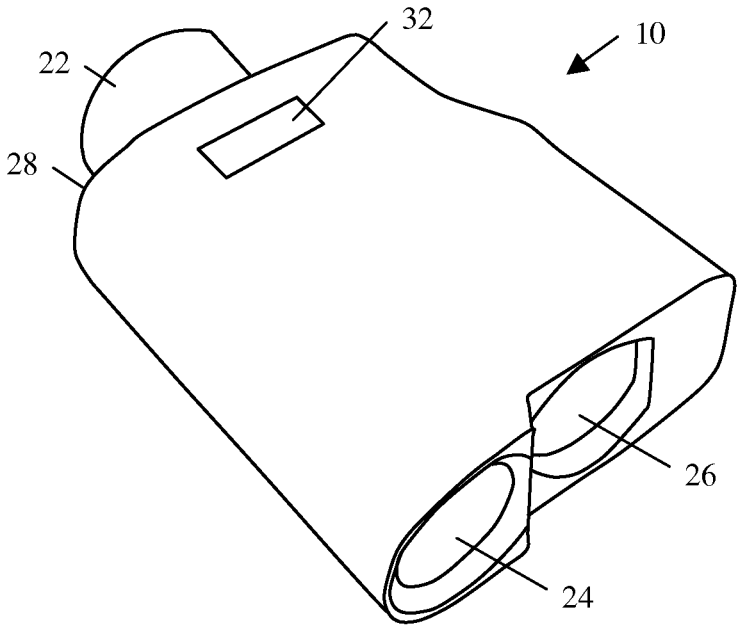
FIG. 15 is a front perspective view of the rangefinder device of FIG. 14.

FIG. 14 is a rear perspective view of an exemplary rangefinder device 10. FIG. 15 is a front perspective view of the rangefinder device 10 of FIG. 15. FIG. 3 shows the internal components.

For instance, the user may look through the eyepiece 22, align the target T, view the target T, and generally simultaneously view the display 30 to determine the first range, the angle, the clear shot indications, and/or other relevant information. The generally simultaneous viewing of the target T and the relevant information enables the user to quickly and easily determine ranges and ballistic information corresponding to various targets by moving the device 10 in an appropriate direction and dynamically viewing the change in the relevant information on the display 30.

The portable handheld housing 20 houses the range sensor 12, tilt sensor 14, computing element 16, and/or other desired elements such as the display 30, one or more inputs 32, eyepiece 22, lens 24, laser emitter, laser detector, etc. The handheld housing 20 enables the device 10 be easily and safely transported and maneuvered for convenient use in a variety of locations.

For example, the portable handheld housing 20 may be easily transported in a backpack for use in the field. Additionally, the location of the components on or within the housing 20, such as the position of the eyepiece 22 on the proximate end 28 of the device 10, the position of the lens 24 on the distal end 26 of the device, and the location of the inputs 32, enables the device 10 to be easily and quickly operated by the user with one hand without a great expenditure of time or effort.

As discussed in reference to FIG. 3, generally a rangefinder device 10 generally includes a range sensor 12 for determining a first range to a target T, a tilt sensor 14 for determining an angle to the target T, a computing element 16 coupled with the range sensor 12 and the tilt sensor 14 for determining ballistic information relating to the target T based on the first range and the determined angle, a memory 18 for storing data such as ballistic information and a computer program to control the functionality of the device 10, and a portable handheld housing 20 for housing the range sensor 12, the tilt sensor 14, the computing element 16, the memory 18, and other components.

A computer program preferably controls input and operation of the device 10. The computer program includes at least one code segment stored in or on a computer-readable medium residing on or accessible by the device 10 for instructing the range sensor 12, tilt sensor 14, computing element 16, and any other related components to operate in the manner described herein. The computer program is preferably stored within the memory 18 and comprises an ordered listing of executable instructions for implementing logical functions in the device 10. However, the computer program may comprise programs and methods for implementing functions in the device 10 which are not an ordered listing, such as hard-wired electronic components, programmable logic such as field-programmable gate arrays (FPGAs), application specific integrated circuits, conventional methods for controlling the operation of electrical or other computing devices, etc.

Similarly, the computer program may be embodied in any computer-readable medium for use by or in connection with an instruction execution system, apparatus, or device, such as a computer-based system, processor-containing system, or other system that can fetch the instructions from the instruction execution system, apparatus, or device, and execute the instructions.

The device 10 and computer programs described herein are merely examples of a device and programs that may be used to implement the present invention and may be replaced with other devices and programs without departing from the scope of the present invention.

The range sensor 12 may be any conventional sensor or device for determining range. The first range may correspond to a line of sight 3 between the device 10 and the target T. Preferably, the range sensor 12 is a laser range sensor which determines the first range to the target by directing a laser beam at the target T, detecting a reflection of the laser beam, measuring the time required for the laser beam to reach the target and return to the range sensor 12, and calculating the first range of the target T from the range sensor 12 based on the measured time.

The range sensor 12 may alternatively or additionally include other range sensing components, such as conventional optical, radio, sonar, or visual range sensing devices to determine the first range in a substantially conventional manner.

The tilt sensor 14 is operable to determine the angle to the target T from the device 10 relative to the horizontal. As discussed in reference to FIGS. 7A, 7B, and 7C, the tilt sensor is used to determine the angle of the line of sight 3. The tilt sensor 14 preferably determines the angle by sensing the orientation of the device 10 relative to the target T and the horizontal.

The tilt sensor 14 preferably determines the angle by sensing the orientation of the device 10 relative to the target T and the horizontal as a user 100 of the device 10 aligns the device 10 with the target T and views the target T through an eyepiece 22 and an opposed lens 24.

For example, if the target T is above the device 10 (e.g. FIG. 7B), the user of the device 10 would tilt the device 10 such that a distal end 26 of the device 10 would be raised relative to a proximate end 28 of the device 10 and the horizontal. Similarly, if the target T is below the device 10 (e.g. FIG. 7C), the user of the device 10 would tilt the device 10 such that the distal end 26 of the device 10 would be lowered relative to the proximate end 28 of the device and the horizontal.

The tilt sensor 14 preferably determines the angle of the target to the device 10 based on the amount of tilt, that is the amount the proximate end 28 is raised or lowered relative to the distal end 26, as described below. The tilt sensor 14 may determine the tilt of the device, and thus the angle, through various orientation determining elements. For instance, the tilt sensor 14 may utilize one or more single-axis or multiple-axis magnetic tilt sensors to detect the strength of a magnetic field around the device 10 or tilt sensor 14 and then determine the tilt of the device 10 and the angle accordingly. The tilt sensor 14 may determine the tilt of the device using other or additional conventional orientation determine elements, including mechanical, chemical, gyroscopic, and/or electronic elements, such as a resistive potentiometer.

Preferably, the tilt sensor 14 is an electronic inclinometer, such as a clinometer, operable to determine both the incline and decline of the device 10 such that the angle may be determined based on the amount of incline or decline. Thus, as the device 10 is aligned with the target T by the user, and the device 10 is tilted such that its proximate end 28 is higher or lower than its distal end 26, the tilt sensor 14 will detect the amount of tilt which is indicative of the angle.

The computing element 16 is coupled with the range sensor 12 and the tilt sensor 14 to determine ballistic information relating to the target T, including clear shot information, as is discussed herein. The computing element 16 may be a microprocessor, microcontroller, or other electrical element or combination of elements, such as a single integrated circuit housed in a single package, multiple integrated circuits housed in single or multiple packages, or any other combination. Similarly, the computing element 16 may be any element that is operable to determine clear shot information from the range and angle information as well as other information as described herein. Thus, the computing element 16 is not limited to conventional microprocessor or microcontroller elements and may include any element that is operable to perform the functions described.

The memory 18 is coupled with the computing element 16 and is operable to store the computer program and a database including ranges, projectile drop values, and configuration information. The memory 18 may be, for example, an electronic, magnetic, optical, electromagnetic, infrared, or semiconductor system, apparatus, device, or propagation medium.

The device 10 also preferably includes a display 30 to indicate relevant information such as the cross hairs 900, distance indicator 910, selectable path indicators 930, clear shot indicator 950, don't shoot indicator 960, not clear indicator 970. The display 30 may be a conventional electronic display, such as a LED, TFT, or LCD display. Preferably, the display 30 is viewed by looking through the eyepiece 22 such that the user may align the target T and simultaneously view relevant information, as shown in FIG. 10. The illuminated segments may be parallel to the optical path (e.g. horizontal) between the eyepiece 22 and the opposed lens 24 and reflect to a piece of angled glass in the optical path.

The inputs 32 are coupled with the computing element 16 to enable users or other devices to share information with the device 10. The inputs 32 are preferably positioned on the housing 20 to enable the user to simultaneously view the display 30 through the eyepiece 22 and function the inputs 32.

The inputs 32 preferably comprise one or more functionable inputs such as buttons, switches, scroll wheels, etc., a touch screen associated with the display 30, voice recognition elements, pointing devices such as mice, touchpads, trackballs, styluses, combinations thereof, etc. Further, the inputs 32 may comprise wired or wireless data transfer elements.

In operation, the user aligns the device 10 with the target T and views the target T on the display 30. The device 10 may provide generally conventional optical functionality, such as magnification or other optical modification, by utilizing the lens 24 and/or the computing element 16. Preferably, the device 10 provides an increased field of vision as compared to conventional riflescopes to facilitate conventional rangefinding functionality. The focal magnification, typically is 4×, 5×, 7×, 12× and so forth. In some embodiments the magnification factor is variable, such as with a zoom feature. This magnification value is used by the computing element 16 in performing the mapping of the various indicators on the optical image is discussed in reference to FIG. 13A.

Further, the user may function the inputs 32 to control the operation of the device 10. For example, the user may activate the device 10, provide configuration information as discussed below, and/or determine a first range, a second range, angle, and ballistic information by functioning one or more of the inputs 32.

For instance, the user may align the target T by centering the reticle over the target T and functioning at least one of the inputs 32 to cause the range sensor 12 to determine the first range. Alternatively, the range sensor 12 may dynamically determine the first range for all aligned objects such that the user is not required to function the inputs 32 to determine the first range. Similarly, the tilt sensor 14 may dynamically determine the angle for all aligned objects or the tilt sensor may determine the angle when the user functions at least one of the inputs 32. Thus, the clear shot information discussed herein may be dynamically displayed to the user.

In various embodiments, the device 10 enables the user to provide configuration information. The configuration information includes mode information to enable the user to select between various projectile modes, such as bow hunting and firearm modes. Further, the configuration information may include projectile information, such as a bullet size, caliber, grain, shape, type, etc. and firearm caliber, size, type, sight-in distance, etc.

The user may provide the configuration information to the device 10 by functioning the inputs 32.

Further, the memory 18 may include information corresponding to configuration information to enable the user-provided configuration information to be stored by the memory 18.

In various embodiments, the device 10 is operable to determine a second range to the target T and display an indication of the second range to the user. The computing element 16 determines the second range to the target T by adjusting the first range based upon the angle. Preferably, the computing element 16 determines the second range by multiplying the first range by the sine or cosine of the angle. For instance, when the hunter is positioned above the target, the first range is multiplied by the sine of the angle to determine the second range. When the hunter is positioned below the target, the first range is multiplied by the cosine of the angle to determine the second range.

Thus, the second range preferably represents a horizontal distance the projectile must travel such that the estimated trajectory of the projectile generally intersects with the target T.

Flow Chart for Determining a Clear Shot

The device 10 may provide clear shot indications using various methods. As discussed above, in some embodiments, a rangefinder device 10 may be operated by a user to manually determine whether or not there is a clear shot.

Figure 16:
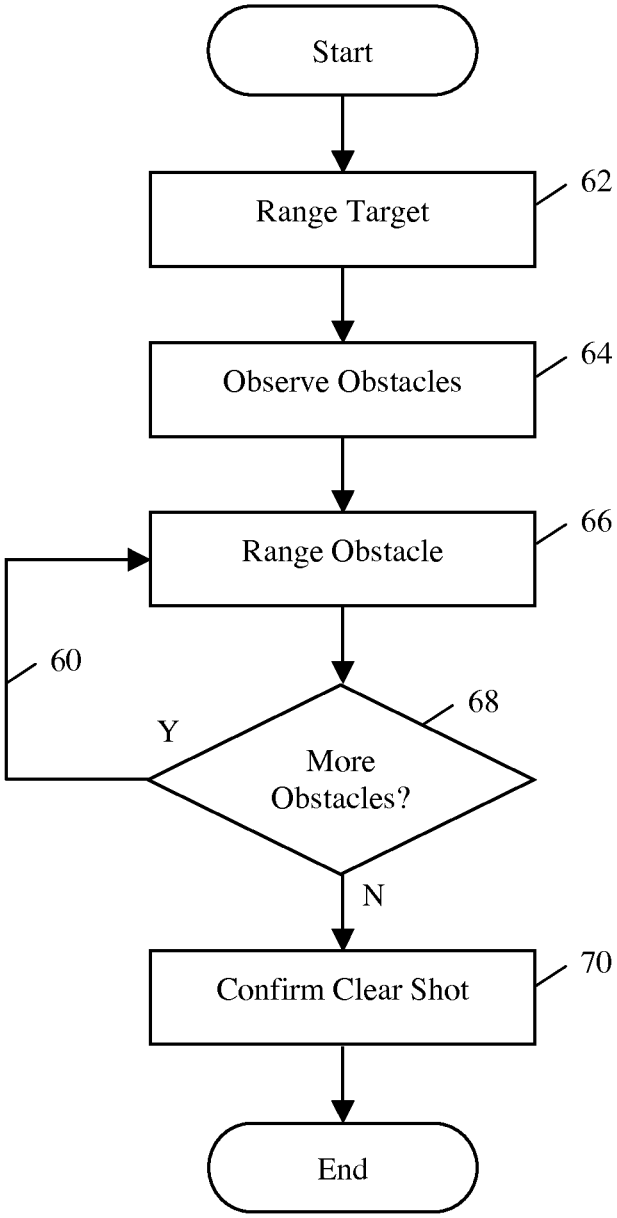
FIG. 16 is a flow chart for a method of using a rangefinder to determine a clear shot.

FIG. 16 is a flow chart for a method of using a rangefinder device 10 to determine a clear shot.

The user 100 operates the device 10 input 32 to determine the first range to the target T in a range target step 62. In step 62, the device 10 displays the first range in the distance indicator 910 and dynamically displays the applicable, path indicators, such as the twenty-yard indicator 920 and forty-yard indicator 940.

In observe obstacles step 64, the user 100 then observes the obstacles that appear between the top path indicator and the cross hairs 900.

In range obstacle step 66, the user 100 finds the range of the first obstacle. Then in more obstacles decision 68, more for obstacles were observed, the flow continues along redo path 60, where the user 100 finds the range of the next obstacle until all potential obstacles have been ranged.

Finally, in a confirm clear shot step 70, the user ranges the target T again and confirms that the obstacle(s) are clear of the projectile trajectory as indicated by the path indicators, such as the twenty-yard indicator 920 and forty-yard indicator 940, in relation the obstacle range(s) obtained in the range obstacle step 66.

Flow Chart for Automatically Determining and Displaying a Clear Shot Indication

Figure 17:
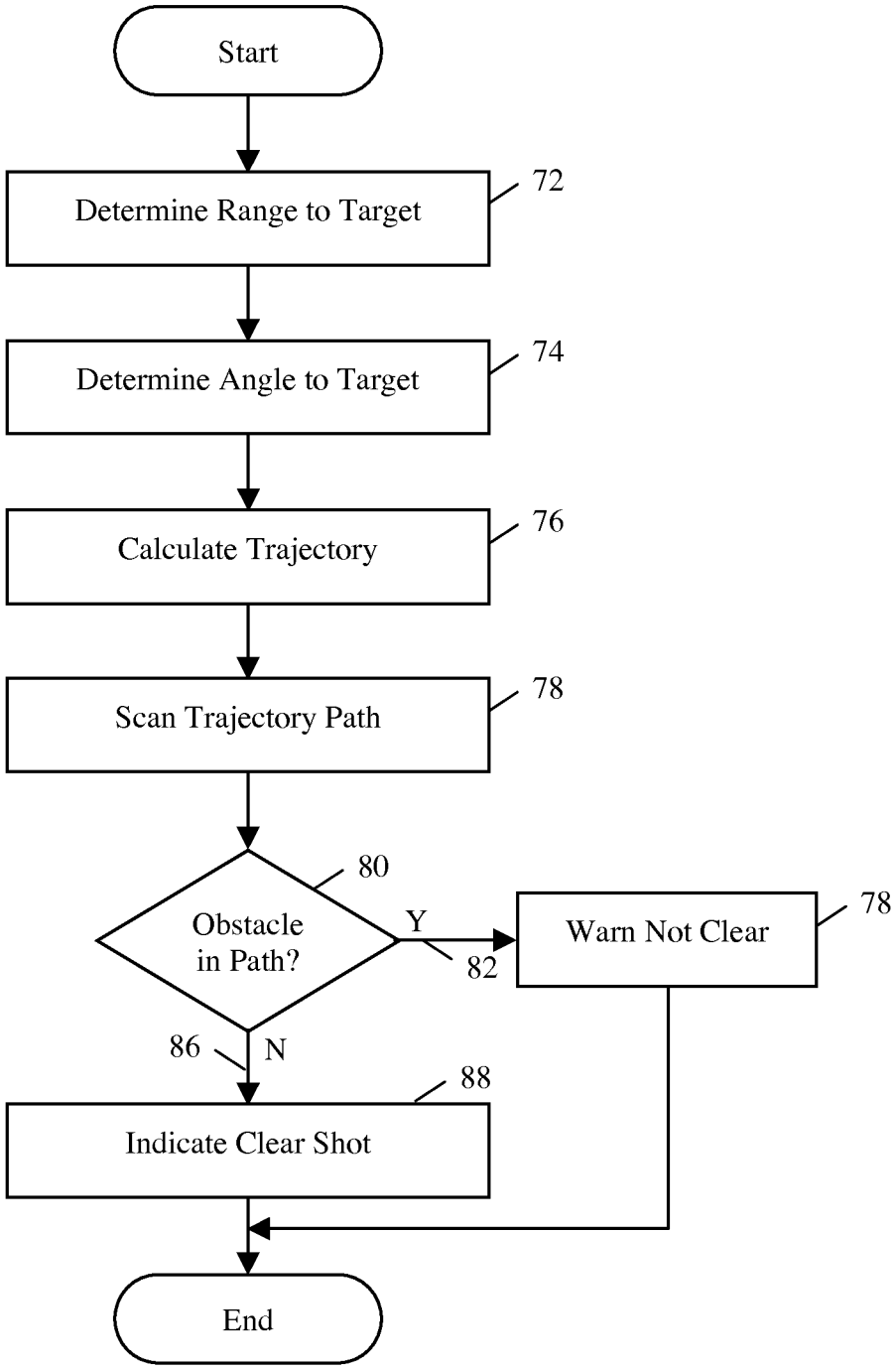
FIG. 17 is a flow chart for a fully automated method of determining a clear shot and providing a clear shot indication.

FIG. 17 is a flow chart for a fully automated method of determining a clear shot and providing a clear shot indication.

First, in a determine range step 72, the device 10 determines the first range to the target T.

In a determine angle step 74, the device 10 determines the angle to the target T.

In a calculate trajectory step 76, the computing element 16 of the device 10 uses the first range and angle, as well as configured weapon and projectile information, to determine a computed model for the projectile trajectory (see, for example, FIGS. 13A and 13B).

In a scan trajectory path step 78, the device 10 uses the range sensor 12 to scan each point along projectile trajectory to determine if an obstacle is found in the projectile trajectory. In one embodiment, the device 10 internally moves the range sensor 12 between the line of sight 3 and the line departure 1. In another embodiment, the user 100 is prompted to tilt the device 10 up slowly until the line of departure is reached. In the later embodiment, the device 10 keeps track in memory 18 each angle that is successfully ranged. If the user 100 moved the device 10 faster than the device could range each angle, the user is prompted to repeat the device tilt motion until all the necessary angles are ranged. For each angle a record is made in memory 18 of whether or not an obstacle was encountered at the distance which corresponds to the projectile trajectory.

In an obstacle-in-path decision 80, memory 18 is checked to see if any obstacle was found in the projectile trajectory.

If any obstacle was found in the projectile trajectory, flow continues along a yes path 82 to a warn not clear step 84. As discussed above, the not clear warning can be provided in various ways. In the embodiments shown in FIG. 11C and 19B, the not clear indicator 970 can be illuminated. In the embodiments shown in FIGS. 11C and 11D, the don't shoot indicator 960 can be displayed over each obstacle.

Otherwise, if no obstacle was found in the projectile trajectory, flow continues along a no path 86 to a indicate clear shot step 88. As discussed above, the clear shot indication can be provided in various ways. In the embodiment shown in FIG. 11A the path indicators, such as the twenty-yard indicator 920 and forty-yard indicator 940, are displayed with no obstacles shown. In the embodiment shown in FIG. 11B the path indicators, such as the twenty-yard indicator 920 and forty-yard indicator 940, are displayed with no obstacles shown and the clear shot indicator 950 is explicitly illuminated.

Steps for Calibrating a Device to a Specific User's Bow and Bow Sight

Figure 18A:
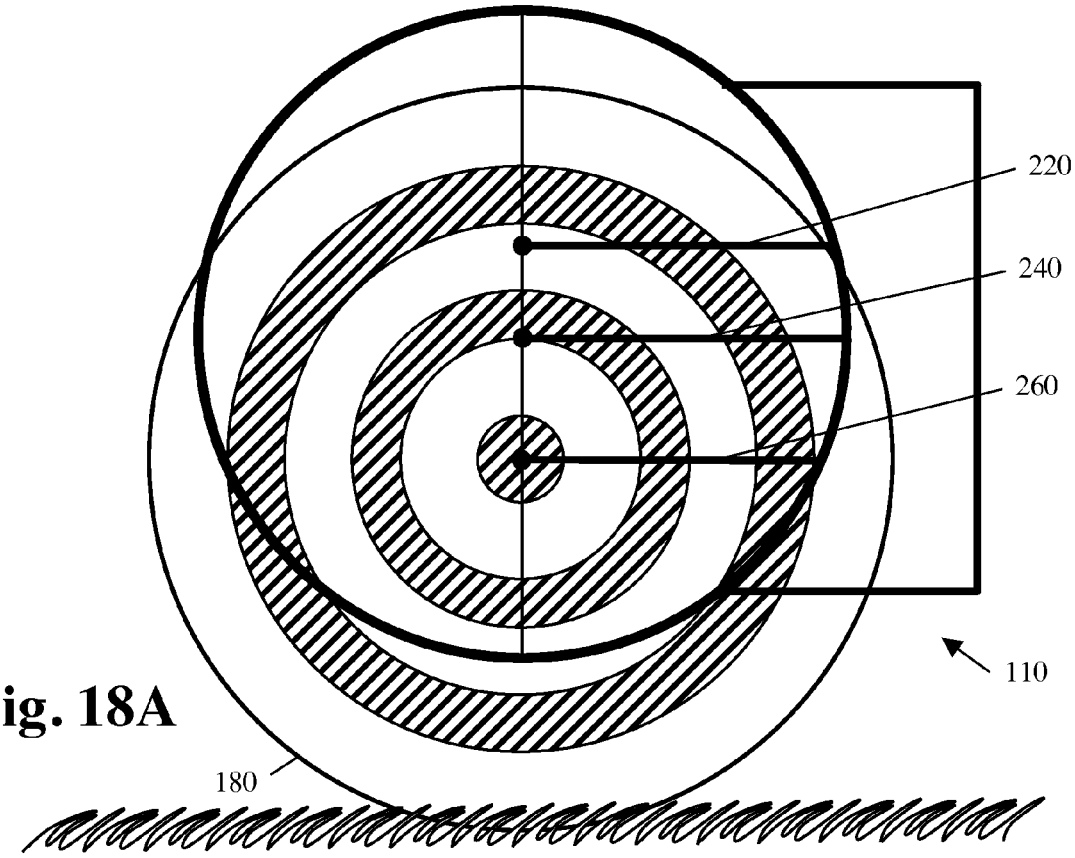
FIGS. 18A through 18C illustrates the steps in a method for calibrating a rangefinder device to a specific user's bow and bow sight.
Figure 18B:
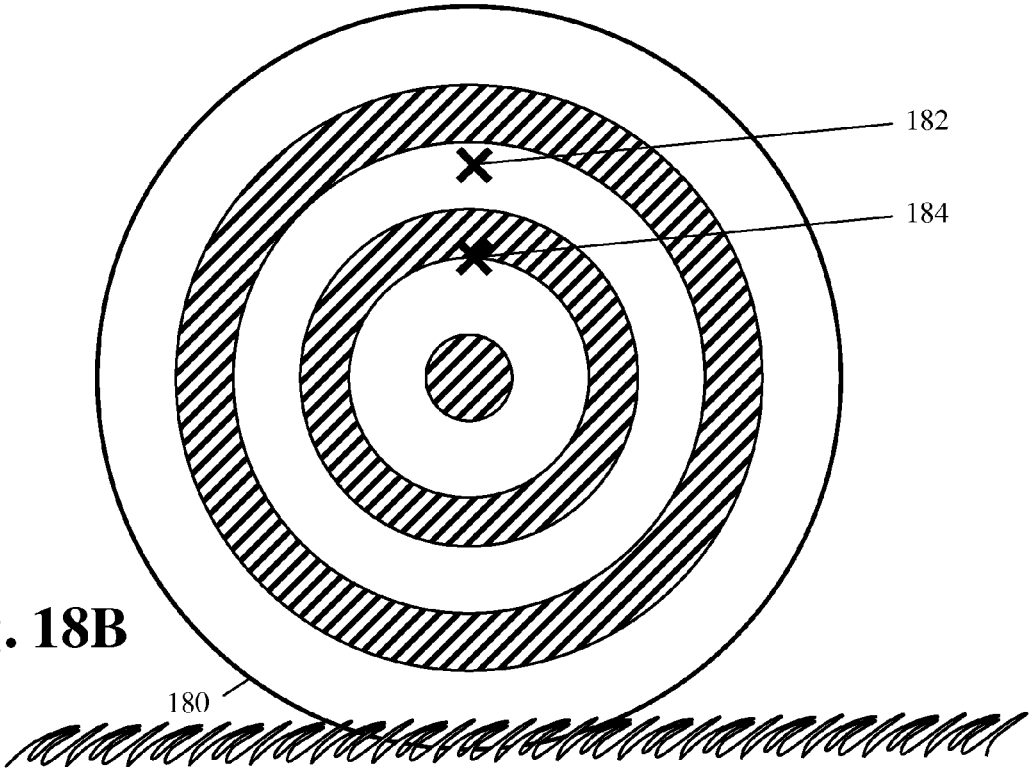
Figure 18C:
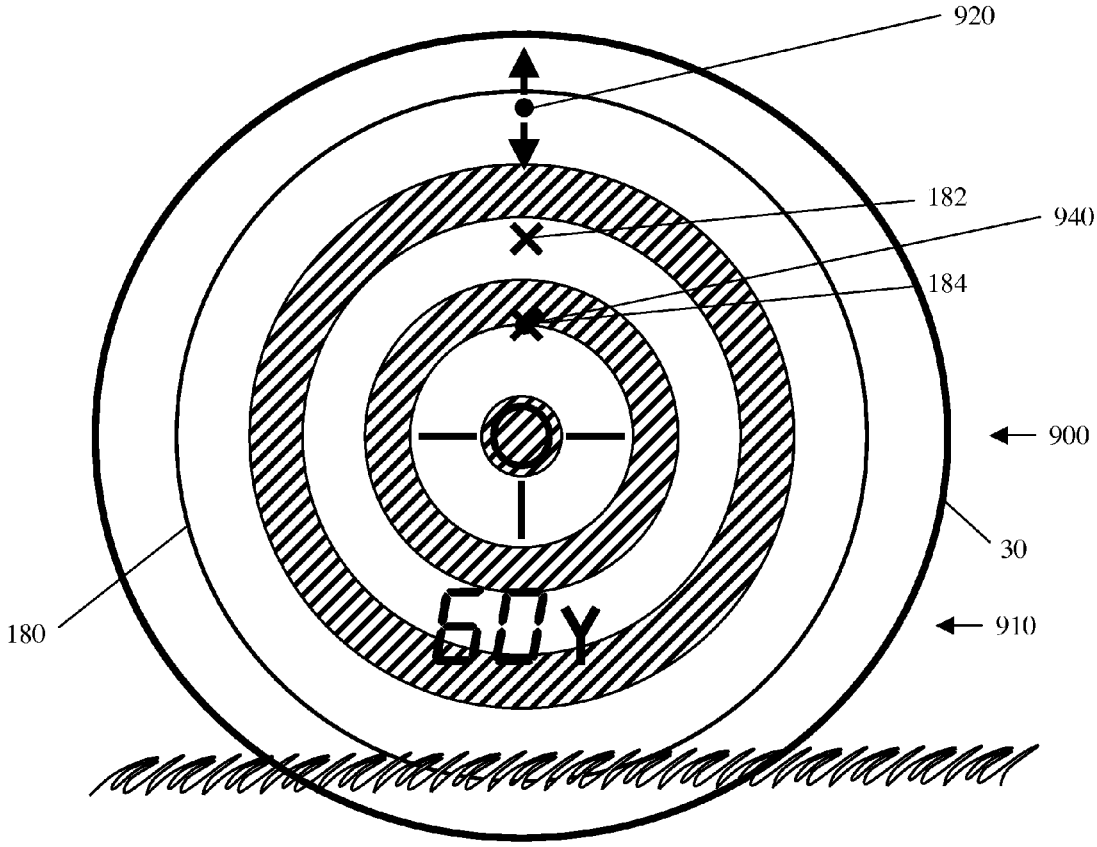

FIGS. 18A through 18C illustrates the steps in a method for calibrating a rangefinder device 10 to a specific user's bow 102 and bow sight 110.

Typically a user will use a paper target 180 at known distances to set one or more bow sight pins, such as twenty-yard pin 220, forty-yard pin 240, sixty-yard pin 260 (FIG. 2).

The following steps may be used to calibrate the device 10 to correspond to a specific user's bow sight 110.

As shown in FIG. 18A, the user 100, places an exemplary paper target 180, shown as a conventional archery target with concentric rings, at sixty yards. The user 100 then aims the bow 102 placing the sixty-yard pin 260 over the center of the paper target 180. The user observes where the twenty-yard pin 220 and the forty-yard pin 240 appear on the paper target 180.

Next, as shown in FIG. 18B the user 100 (or an assistant) places a mark where each pin appeared at sixty yards. For example, a twenty-yard mark 182 and a forty-yard mark 184, respectively, are shown on the target in FIG. 18B.

Next, as shown in FIG. 18C, the user 100 holds the device 10 at the same sixty yard distance and enters bow calibration mode. The distance indicator 910 should read sixty yards. In some embodiments, the device 10 will prompt the user 100 to position the twenty-yard indicator 920 over the twenty-yard mark 182. After the prompt, each time the user 100 operates an input 32 the next one of the plurality of selectable path indicators 930 will be illuminated. The user 100 will continue to adjust the position of the illuminated selectable path indicators 930 until it matches the twenty-yard mark 182 on the paper target 180. Once the first path indicator is calibrated, then the device 10 prompts the user 100 to position the next path indicator, for example, the forty-yard indicator 940 over the forty-yard mark 184, in a similar manner, until all the pins have been calibrated.

Based on this calibration information the device 10 can determine the parabolic curve (projectile trajectory) applicable to the user's specific bow 102 and bow sight 110.

In a simpler embodiment, corresponding to FIGS. 9A and 9B only, the device 10 operates with only a single path indicator, such as only the twenty-yard indicator 920. Correspondingly, an alternate calibration method is simpler as well. In this simpler embodiment, the paper target 180 is positioned at forty yards. The distance indicator 910 should read forty yards. The paper target is marked only with the twenty-yard mark 182. Next, the device 10 will prompt the user 100 to position the twenty-yard indicator 920 over the twenty-yard mark 182, whereupon the calibration is complete.

Reverse Application

The method by which the path indicators, such as the twenty-yard indicator 920 and/or the forty-yard indicator 940, are used to calibrate the device 10 (by determining the corresponding projectile trajectory 2) may be understood by reference to FIG. 13A. Essentially, the method used to determine the location of the path indicators based on the projectile trajectory 2 is reversed.

The calibrated locations, for example, the twenty-yard indicator 920 and/or the forty-yard indicator 940 indicate the height on the millimeter y-axis of the corresponding project lines, for example, the twenty-yard projection 420 line and optionally the forty-yard projection 440 line. The projection line(s) are modeled starting at the origin point $P_0$ (0, 0) and ending at the projected points (e.g 920 and/or 940) at the sixty yard x-axis. The intersection points, $P_{20}$ and $P_{40}$, respectively are then determined where the twenty-yard projection 420 line and optionally the forty-yard projection 440 line cross the twenty-yard line 320 and the forty-yard line 340, respectively. The origin point $P_0$ (0, 0), and the twenty-yard intersection point $P_{2o}$ (20, $y_{20}$) are then used to calculate the parabola. If the forty-yard intersection point $P_{4o}$ (40, $y_{40}$) is also used, the difference between $y_{20}$ and $y_{40}$ will provide an indication of the air drag impact on the projectile trajectory 2. Thus, the projectile trajectory 2 that corresponds to an individual user's bow 102 and bow sight 110 is determined.

In the example shown in FIG. 13A, the twenty-yard indicator 920 is calibrated at six millimeters (on the display y-axis). This corresponds to thirty yards based on the focal range conversion. The tangent is 30/60 or 0.5. The inverse tangent function provides the angle of the twenty-yard projection 420 line, $\theta_{20}$ arctan(0.5) equals 26.6 degrees. This angle can then be used to calculate the twenty-yard intersection point $P_{2o}$. Once $P_{2o}$ is known, the corresponding parabolic equation is determined using $y_{20}$ in the equation explained below.

Alternatively, in yet another calibration method, the user 100 can compare the bow sight pins (220, 240, 260) to a printed set of common settings and then enter associated values or code to provide the device with corresponding projectile trajectory 2 data. The code can be used to perform a lookup of the projectile trajectory 2.

In yet another calibration embodiment, the user 100 measures the distance between the twenty-yard pin 220 and the forty-yard pin 240, and the distance between the forty-yard pin 240 and the sixty-yard pin 260 and enters those values into the device 10. The device 10 uses those values, in a method similar to one described above, to calculate the corresponding projectile trajectory 2, or to lookup the projectile trajectory 2 in a table stored in memory 18.

Single Point Sufficient

Conventionally, it is understood that to determine a parabola three points must be known. This is because in either the standard form or the vertex form there are three variables in addition to the x and y values for the points (namely, A, B, and C in standard form or A, h, and k in vertex form). However, with the model, methods, and devices disclosed herein, only one value, specifically the $y_{20}$, is needed to determine the parabola.

In reference to the model shown in FIG. 13A, and the calibration methods discussed in reference to FIGS. 18A through 18C, the origin point $P_o$ is always (0, 0) and the T point is always (60, 0). Using these values for $x_0$, $y_0$, $y_{60}$ and $y_{60}$ two of the unknowns may be solved with A remaining as the only unknown. The x value of the twenty-yard intersection point $P_{2o}$ (20, $y_{20}$) is always 20. Thus, only a single equation with a single value, $y_{20}$ is needed to determine all the other variables in the standard or vertex form of parabolic equations.

The single equation to find A based on $y_{20}$ is as follows:

$$A=-y_{20}/800$$

Once A is known, the other equations are:

$$B=0.075y_{20}$$

$$C=0$$

$$h=-B/2A=30$$

$$k=C-B^2/4A=-B^2/4A=1.125y_{20}$$

Two Points Provide Air Drag Adjustment

In our model, if there were no air drag, height of the projectile trajectory 2 would be the same at both the twenty-yard intersection point $P_{2o}$ (20, $y_{20}$) and the forty-yard intersection point $P_{4o}$ (40, $y_{40}$), $y_{20}$ equals $y_{40}$. If $y_{20}$ does not equal $y_{4o}$, the difference between $y_{20}$ and $y_{40}$ will provide an indication of the air drag impact on the projectile trajectory 2. Thus if the user provides a second point, the device 10 can determine the affect of air drag on the projectile and adjust the projectile trajectory 2 and clear shot indications according.

Air drag calculations are very complex and a table look up is often used to apply the air drag adjustments to the true parabolic values. In a embodiment which uses a second calibration point the difference between $y_{20}$ and $y_{40}$ is used with other projectile data to select a table of adjustment values which are then applied to the true parabolic values to map out the adjusted projectile trajectory 2.

In a smart rangefinder embodiment described below, a dynamic table of air drag values is filled in based on analysis of an actual video of an individual projectile shot in a known environment, such as the sixty yard paper target 180 of FIG. 18C.

Alternative Displays

Figure 19A:
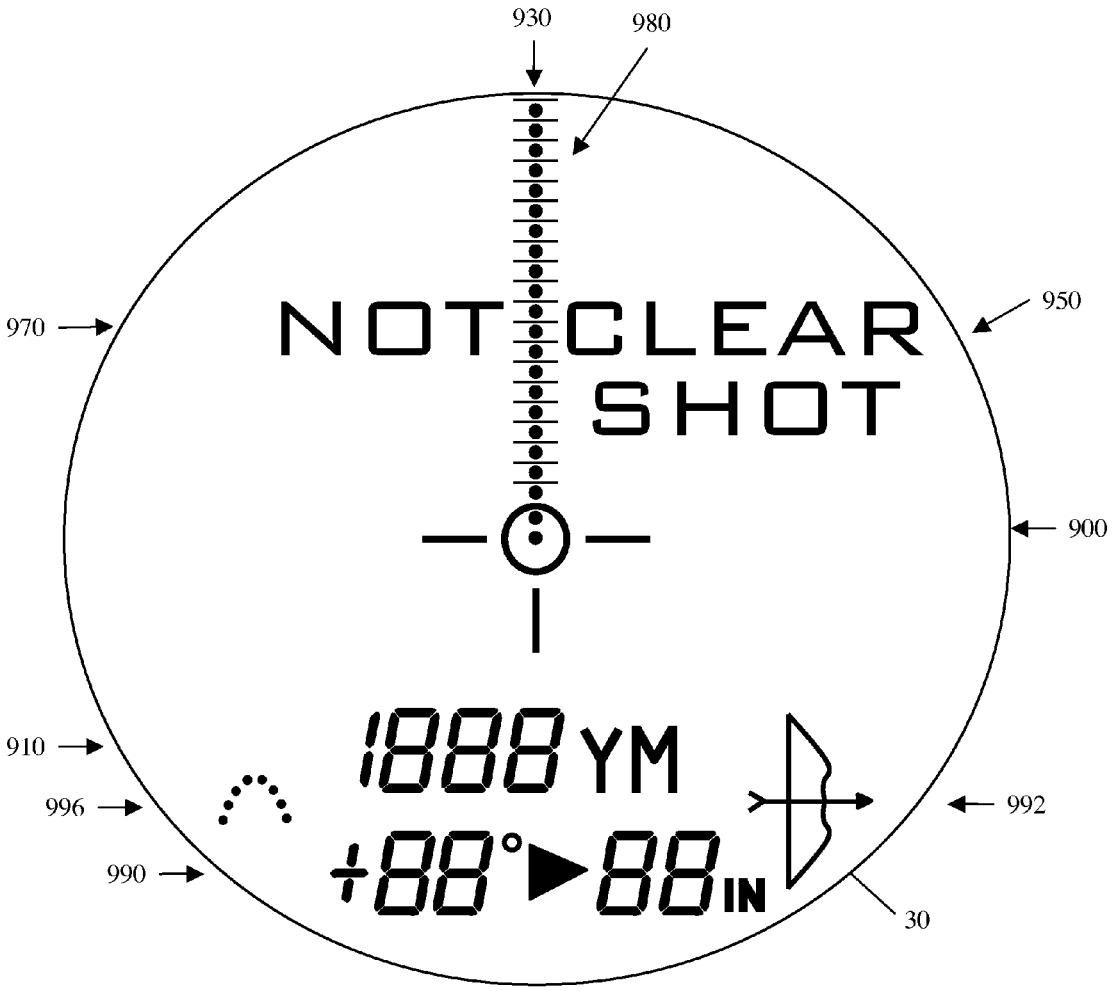
FIGS. 19A and 19B illustrates an alternate display having dynamic path indicators, including embodiments with twenty-yard and forty-yard indicators, maximum indicator, angle and second range indicator, mode indicators, such as a bow mode indicator.
Figure 19B:
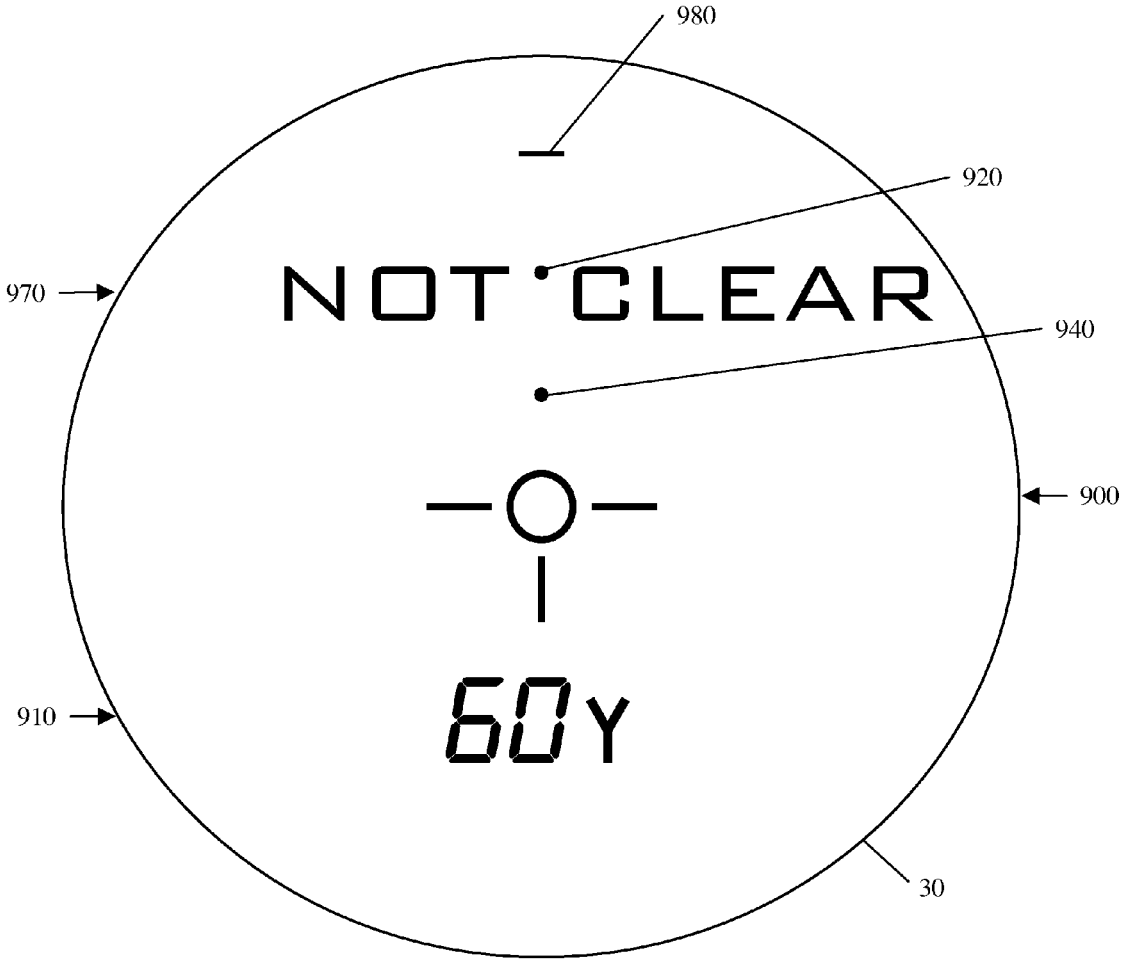

FIGS. 19A and 19B illustrates an embodiment of an alternate design for the display segments, including dynamic path indicators, including embodiments with twenty-yard and forty-yard indicators (920 and 940), maximum indicators 980, angle and second range indicator 990, bow mode indicator 992.

FIG. 19A shows an alternative design for display 30. In addition the display elements discussed above in relation to FIG. 10, one or more of the following may be included in various embodiments of the display 30: the not clear indicator 970 (see also FIG. 11C), a plurality of maximum indicators 980, an angle and second range indicator 990, and/or a bow mode indicator 992.

A novel trajectory mode indicator 996 indicates that clear shot projectile trajectory information is being calculated and/or displayed.

Other modes could be displayed with different symbols, such as a rifle symbol to indicated rifle mode indicator 994 (not shown) or a group of bushes to indicate brush mode (not shown).

As shown in FIG. 19B only one of the plurality of maximum indicators 980 is illuminated to show the highest point in the projectile trajectory (this corresponds to the line of departure 1, for example, such as line 1*c* as shown in FIG. 13A).

The maximum indicator 980 is also the true aim point. A bow sight comprising a single pin aligned with the bow string sight 120 (shown in FIG. 1) would provide the user with a true aiming point. A bow with a true aim pin could be used with our clear shot technology to eliminate conventional bow sights, and would not need adjustment.

Also shown illuminated in FIG. 19B is the not clear indicator 970. In some embodiments, the word "CLEAR" in the clear shot indicator 950 is used in combination with the word "NOT" in the not clear indicator 970, to illuminate the words "NOT CLEAR" while the word "SHOT" is not illuminated. In other embodiments a large red circle with a back slash (similar to don't shoot indicator 960) could be superimposed over the entire circular focus area.

Also as shown illuminated in FIG. 19B are the optional angle and second range indicator 990 and the optional bow mode indicator 992. The other segments shown in FIG. 9C (900, 910, 920, and 940) are also shown illuminated.

Game Displays

One challenge to the adoption of the clear shot technology is the education of potential users and buyers on the use and benefits of the technology.

Yet another display aspect of the present invention is a game that simulates the operation of a device 10 having the clear shot technology. The game could operate as a computer program running on mobile device such as an Apple iPhone 11 or Google Droid; a gaming system such as a Sony PS3, Nintendo Wii, or Microsoft Xbox; or a general purpose computer such as a Apple Macintosh or a Wintel platform. The game could also be implemented as a Web based applet that would run inside a Web browser.

Figure 20:
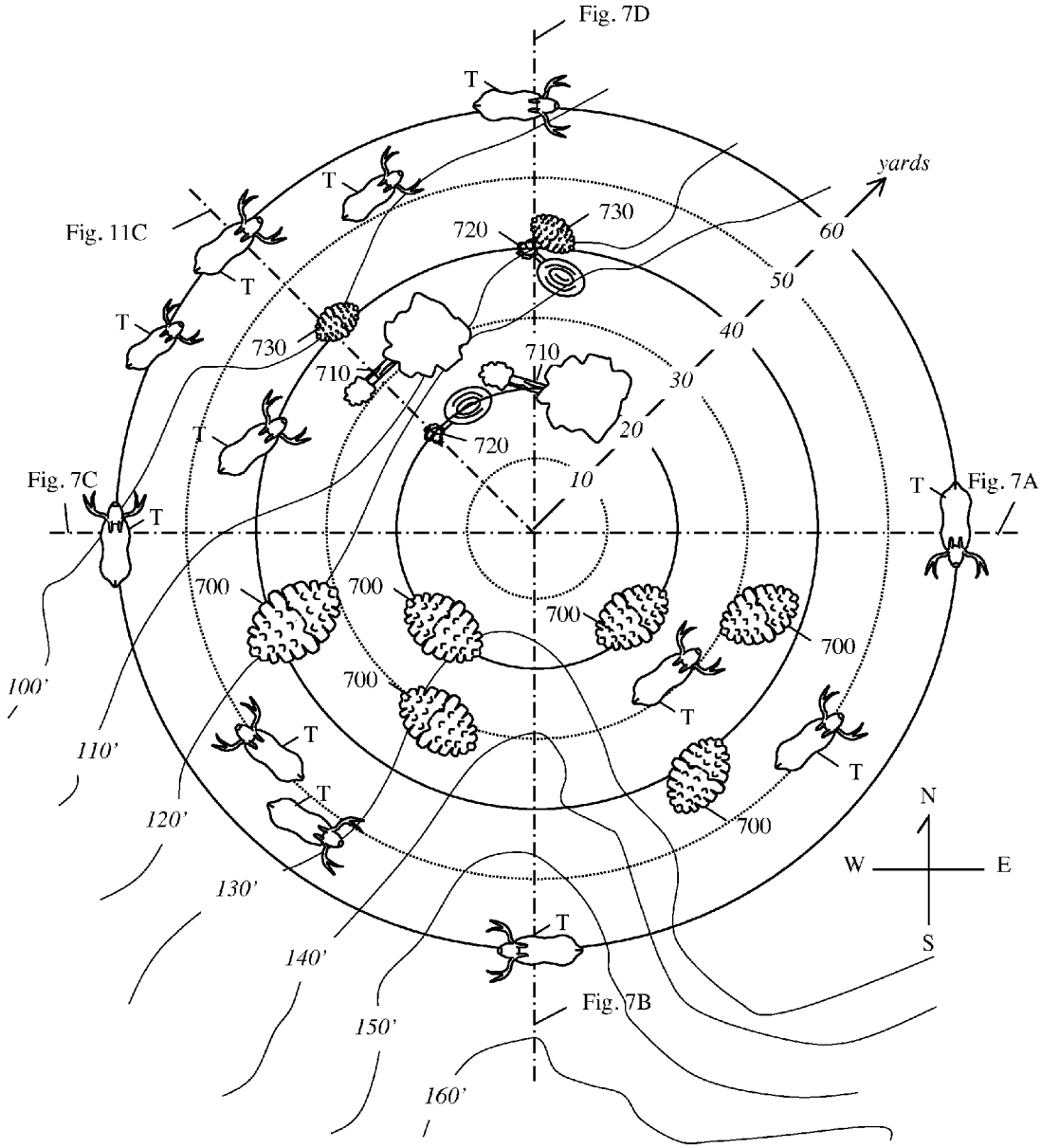
FIG. 20 is a contour map, or chart, showing an exemplary layout of a virtual world for a game having a display providing a clear shot indication.

In one embodiment, the game would simulate the use of the device 10, by created a virtual world with a plurality of targets and obstacles at different elevations and distances from a common center point. FIG. 20 shows an exemplary layout chart, or map, of such a virtual world. FIG. 20 is an overhead view which users contour lines to show higher and lower elevations (shown as 100 feet through 160 feet). Concentric circles show various ranges, such as ten, twenty, thirty, forty, fifty and sixty yards. Different situations are represented at various compass headings. For example, the situation shown is FIG. 7A is laid out at 90 degrees east, as indicated by the line labeled 7A. Likewise, the situation of FIG. 7B is laid out to the south (line 7B), the situation of FIG. 7C is laid out to the west (line 7C), and the situation of FIG. 7D is laid out to the north (line 7D). Further the don't shoot situation of FIG. 11C is laid out to the northwest. Other targets and obstacles are also illustrated on the chart. For improved enjoyment the targets could represent different objects such as deer, antelope, elk, moose, rabbit, skunks, coyote, lions, tigers, bears, and so forth. The obstacles and surrounding could include different environments such as eastern forest, jungle, desert, alpine, and so forth.

In an iPhone embodiment, the game uses the iPhone's motion sensors to determine a relative compass direction and tilt angle for the simulated device. As the game user moves the iPhone, different targets and obstacles come into view. When the user taps the screen over a range button (such as display input 34*a* in FIG. 21), the display 30 of the simulated device 10 would calculate the projectile trajectory 2 and indicate a clear shot or not, as explained above. When the user taps the screen over a fire button (such as display input 34*b* in FIG. 21), the display screen would show an animation changing the view from simulated eyepiece view, to a side view similar to the kind illustrated in FIG. 7A through 7D, or alternatively in FIG. 32. In some embodiments, the projectile's path could be animated, leaving a trail as it flies.

In other platforms, the game would use buttons or game controllers to move the simulated device 10 in different compass directions and to tilt the device 10 to view different potential targets. In a Wii embodiment, the Wii nunchuk controller could be used to simulate both the device 10 and the weapon, such as a bow 102

The game would contain data that models the virtual world, and would use that data in accordance with the methods described above related to a physical display 30 or device 10, to determine the projectile trajectory and to provide the various clear shot indications, including path indicators and clear shot indicators.

The demo version of the game could be provided in kiosks at trade shows, on the manufacturer's or retailer's Web sites, or as downloadable applications, for example via Apple's AppStore.

Thus, potential users or buyers would be educated regarding the user, operation, and value of the clear shot technology.

A professional version of the game with more sophisticated graphics and environments could also be sold in the video gaming markets. Such a game would help introduce a new generation of users to the sports of archery and shooting.

Ring of Fire Mode

We have discovered that in our bow hunting experience, knowing which objects are forty yards away is very useful. When objects that are forty yards away are known, objects that are a little closer are about thirty yards away and objects that are a little farther are about fifty yards away. Most bow hunters are comfortable shooting in this range between thirty and fifty yards. We refer to this as the "ring of fire." The ring of fire can be visualized in reference to FIG. 20 as the "donut" between the thirty and fifty yard circles with landmarks being the objects that lie on the forty-yard circle.

Another device aspect of the present invention is a ring of fire mode. When the device 10 is placed in ring of fire mode, the device 10 automatically, and continually, ranges objects as the device is moved. In one embodiment, when an object is about forty yards away, the cross hairs 900 and the distance indicator 910 flash. In one high-resolution display and digital camera embodiment, the objects in the ring of fire are highlighted (see discussion below regarding FIG. 31).

One use of the ring of fire mode is, while stalking potential targets, to scan the general area until the user reaches the optimal forty yard distance from the potential targets.

Another use of the ring of fire mode is, while positioning a tree stand, to determine landmarks on the ground that can be used to determine when passing targets have entered the ring of fire.

Yet another use of the ring of fire mode is, while calling targets such as elk or moose into a shooting range, to determine landmark objects that can be used to determine when called targets have entered the ring of fire.

High-Resolution Digital Display

Figure 21:
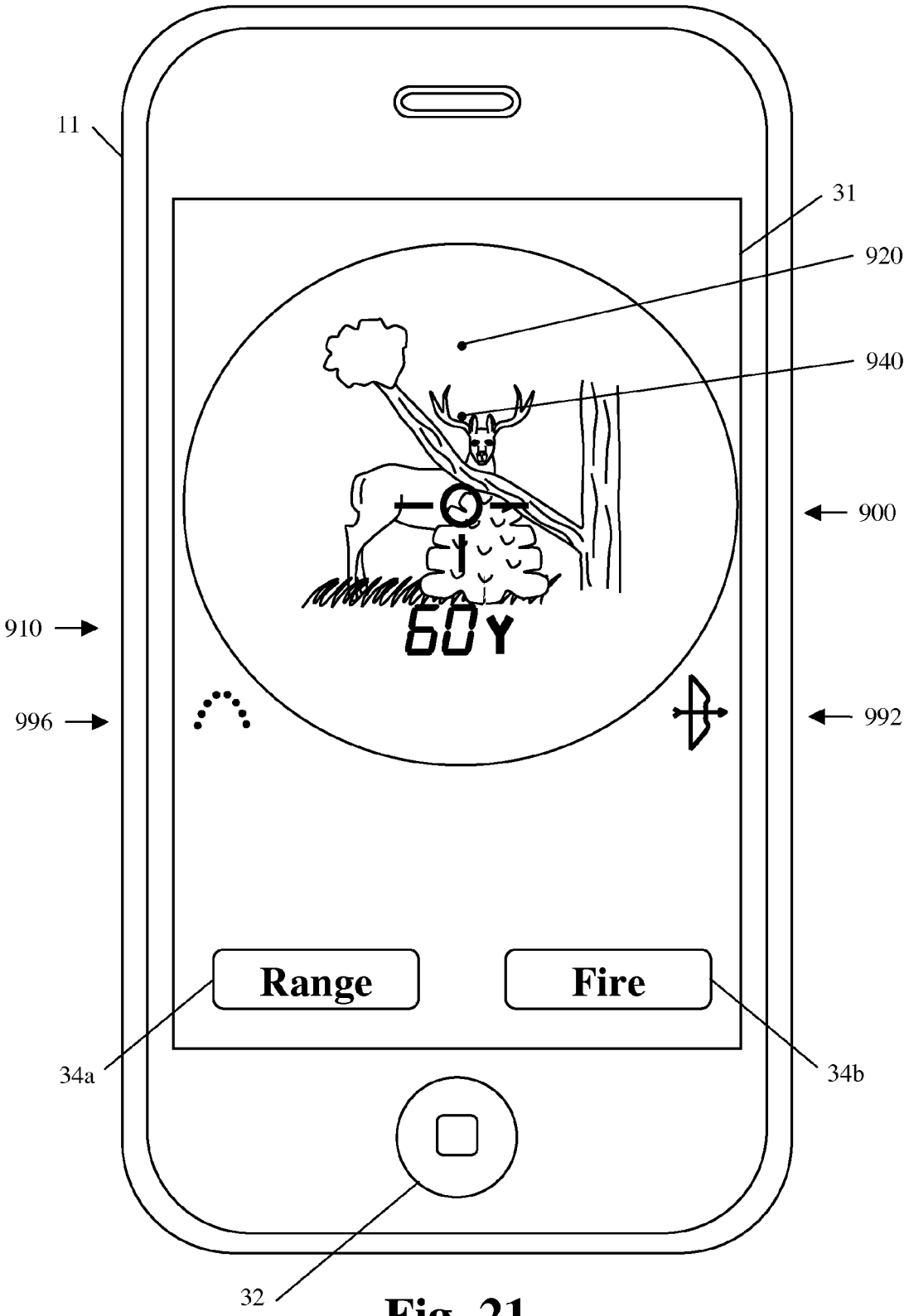
FIG. 21 shows a high-resolution digital display providing a clear shot indication and also shows optional game inputs.

FIG. 21 shows a high-resolution display 31 providing digital video superimposed with a clear shot indication, such as the twenty-yard indicator 920 and the forty-yard indicator 940.

FIG. 21 also shows optional placement of various mode indicators. For example, the bow mode indicator 992 and the trajectory mode indicator 996 are shown in the corners of a rectangular digital, high-resolution display 31, in this example, a touch screen display of an Apple iPhone 11.

One advantage of a digital, high-resolution display 31 is that it is not limited to the circular optical focus area. The additional area of the rectangular display can be used for various purposes. As shown in FIG. 21 the various mode indicators, including bow mode indicator 992, rifle mode indicator 994 (not shown), trajectory mode indicator 996, ring-of-fire indicator 998 (FIG. 31) can be moved outside the circular focus area, for example, to the lower corners. Other indicators, such as the distance indicator 910 angle and second range indicator 990, can also be moved outside the circular focus area. This has the advantage of allowing the circular focus area to be less cluttered and to obscure less of the optical image information. Further, the rectangular high-resolution display 31 can provide more optical information.

Another advantage of a high-resolution display 31 is that the overlay information is produced by software rather than by a hardware chip. Custom hardware chips can be expensive to design and manufacture and are less flexible. The overlay information generated by software for display on the high-resolution display 31 is higher quality, such as easier to read fonts, and move flexible, such as being able to display in different colors or locations of the screen to avoid obscuring the optical information being overlaid. The display can have more options, such as natural languages, different number systems such as Chinese, different units of measure, and so forth. Further, the software can be easily updated to incorporate new features, to improve calculations, or to support addition projectile information. Updates can be made in the field as well as in new models at a lower cost. For example, in some embodiments, new software can be downloaded over the Internet.

Other advantages of high-resolution display 31 will be discussed in references to FIG. 22 through FIG. 33.

High-Resolution Touch Screen Display

FIG. 21 also shows an exemplary touch screen display as an embodiment of the high-resolution display 31. The high-resolution display 31 displays the video image as digitally captured by the digital camera 25 (see FIGS. 22, 23, 25, and 27) or as simulated by the game software; the overlay information such as the twenty-yard indicator 920 and the forty-yard indicator 940, the cross hairs 900, the distance indicator 910, the mode indicators (e.g. 992 and 996), and the display inputs 34, shown as range button (34*a*) and fire button (34*b*). The display inputs 34 are virtual buttons that are tapped on a touch screen, or clicked on with a pointing device (or game controller). The input 32 is a physical button. Both inputs 32 and display inputs 34 provide input to the computing element 16 (FIG. 3).

The embodiment shown comprises a mobile smart phone, in particular an Apple iPhone 11. Correlating FIG. 3 with FIG. 21, the computing element 16 is the processor of the iPhone 11; the memory 18 is the memory of the iPhone 11; the tilt sensor 14 is the accelerometer of the iPhone 11; and the display 30 is the touch screen display of the iPhone 11, an embodiment of the high-resolution display 31. The range sensor 12 is simulated in the game embodiments, or as enhancement to the iPhone 11 as discussed in reference to FIGS. 24 through 27.

Digital Rangefinder Devices

Figure 22:
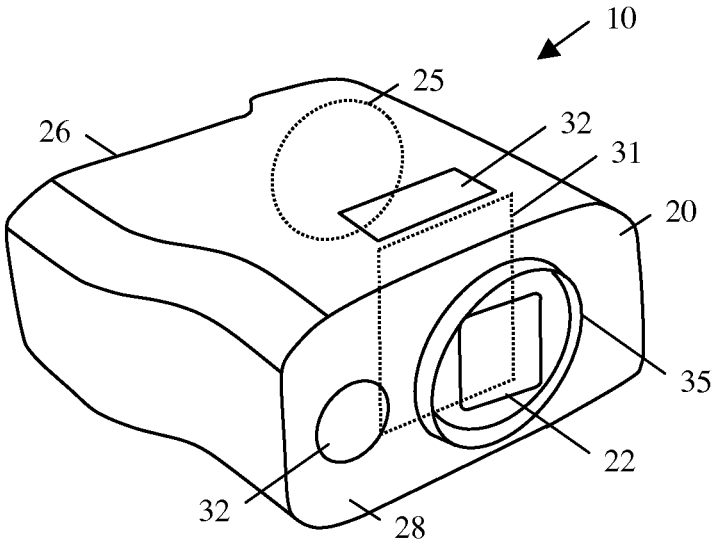
FIG. 22 is a rear perspective view of a digital rangefinder device.
Figure 23:
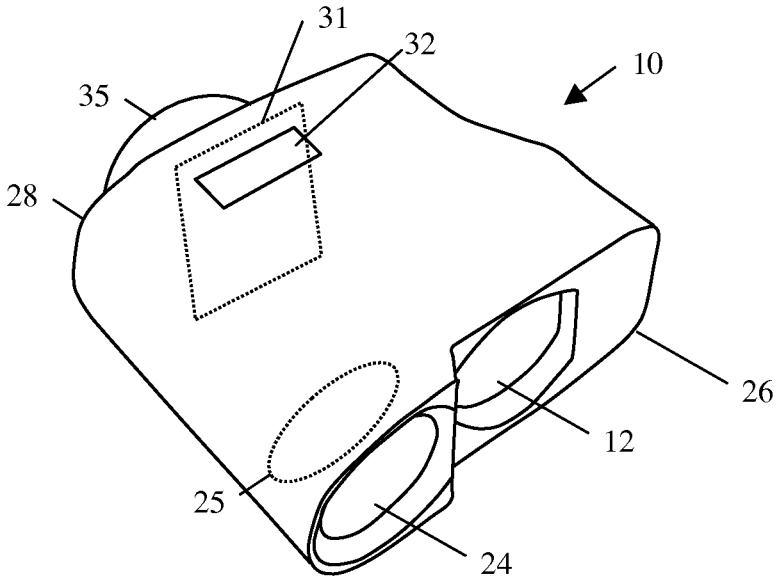
FIG. 23 is a front perspective view of the rangefinder device of FIG. 22.

FIGS. 22 and 23 are rear and front perspective views, respectively, of a digital embodiment of rangefinder device 10.

The digital rangefinder device 10 comprise a housing 20, having an eyepiece 22 at the proximate end 28, a lens 24 and range sensor 12 at the distal end 26, and inputs 32 in various places on exterior. In contrast to the conventional rangefinder, the housing 20 contains a digital camera 25 that captures and digitizes video from the optical image through the lens 24 and contains a digital, high-resolution display 31. The video comprises a series of image frames. The computing element 16 (FIG. 3) processes the image frames, overlays each frame with various indicators, and displays the resulting image on the high-resolution display 31. Further, the high-resolution display 31 is controlled completely by the computing element 16 (FIG. 3) and need not display any of the optical image being captured; instead the high-resolution display 31 may display setup menus, recorded video, or animations generated by the computing element 16 (FIG. 3).

The eyepiece 22 may also be modified to accommodate viewing of the high-resolution display 31. In particular the eyepiece 22 may be inset and be protected by a shroud 35.

In contrast to the conventional rangefinder housing 20 as shown in FIGS. 14 and 15, the housing 20 of the digital rangefinder of FIGS. 22 and 23 is more compact, more lightweight, and easier to transport and use, due to removal of the end to end optics. For example, the length between the proximate end 28 and the distal end 26 is shown as less than about four inches. The width and height could be about two inches respectively Digital Rangefinder Devices Comprising Mobile Smart Phones FIGS. 24 and 25 are rear and front perspective views, respectively, of another digital rangefinder device, comprising an exemplary Apple iPhone and a housing with a range sensor, visor, handle and alternative inputs.

Figure 24:
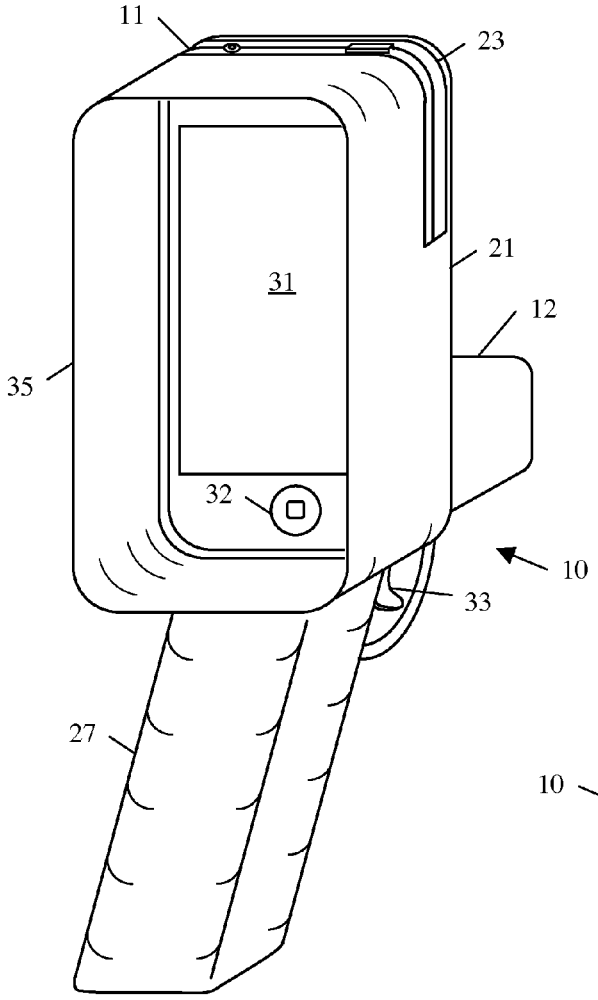
FIG. 24 is a rear perspective view of another digital rangefinder device, comprising an exemplary Apple iPhone and a housing with a range sensor, visor, handle and alternative inputs.

FIG. 24 is a rear perspective view of another digital rangefinder device 10, comprising an exemplary Apple iPhone 11 and an alternate housing 21 with a range sensor 12, visor 35, handle 27 and alternative inputs, such as trigger input 33 and display inputs 34 (FIG. 21). The iPhone 11 is inserted into the alternate housing 21 via a housing slot 23 and is electronically connected via a standard iPhone connector in the housing. The range sensor 12 and the trigger input 33 provide input to the processor of the iPhone 11 via the iPhone connector. The visor or shroud 35 increases the clarity of the high-resolution display 31 in the intense sun and shadows of the outdoors and limits the light from the display 31 which may be seen by wildlife. The shroud 35 is preferable made of flexible rubber or silicon material, and with the alternate housing 21 protects the iPhone 11 from the harsh environment of the outdoors.

Figure 25:
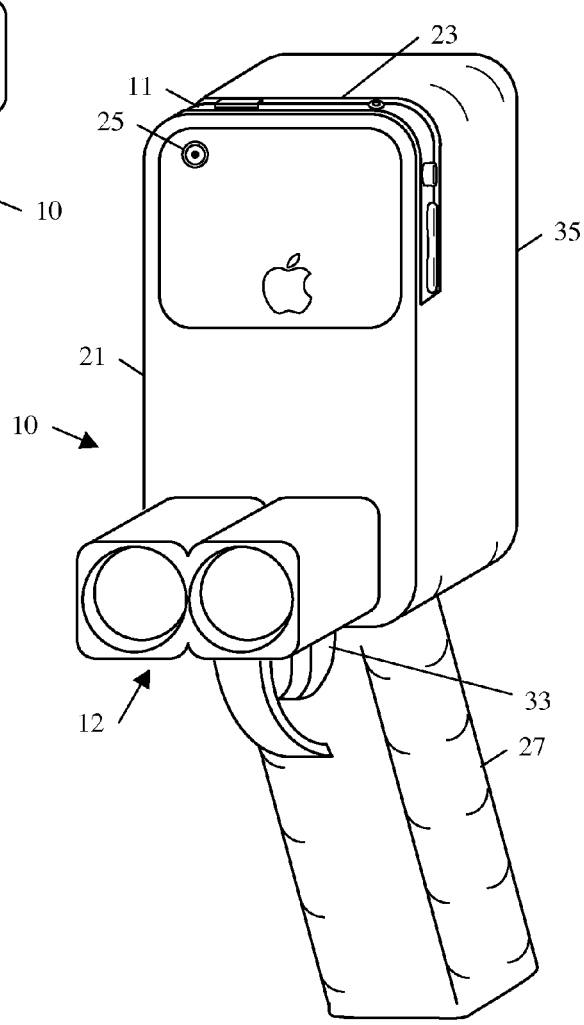
FIG. 25 is a front perspective view of the rangefinder device of FIG. 24.
Figure 26:
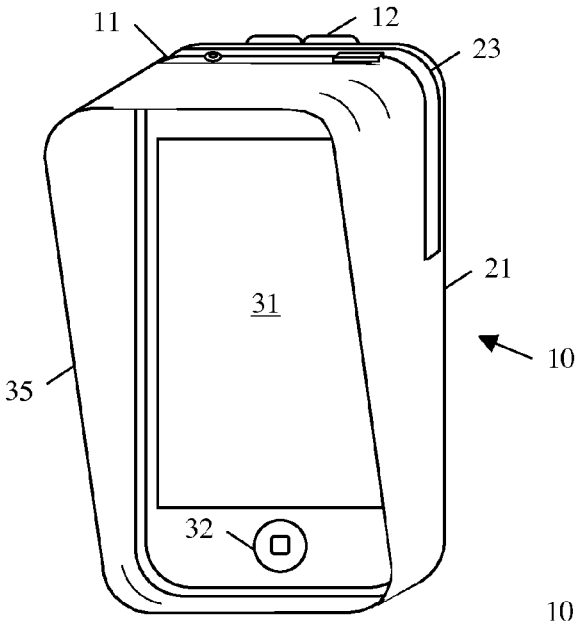
FIG. 26 is a rear perspective view of another digital rangefinder device, comprising an exemplary Apple iPhone and a housing with a range sensor and visor.

FIG. 25 is a front perspective view of the rangefinder device of FIG. 24;

FIG. 26 is a rear perspective view of another digital rangefinder device, comprising an exemplary Apple iPhone 11 and an alternate housing 21 with a range sensor 12 and visor 35.

Figure 27:
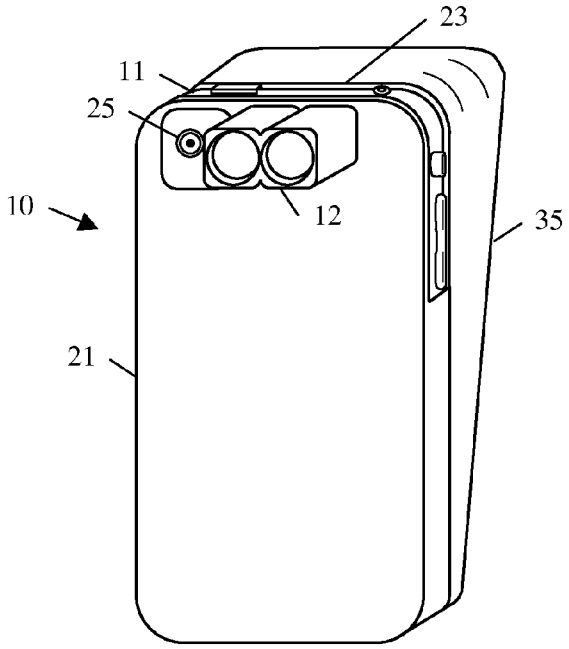
FIG. 27 is a front perspective view of the rangefinder device of FIG. 26.

FIG. 27 is a front perspective view of the rangefinder device of FIG. 26.

In contrast to the alternate housing 21 as shown in FIGS. 24 and 25, the alternate housing 21 of the digital rangefinder of FIGS. 26 and 27 is more compact, more lightweight, and easier to transport and use, due to removal of the handle 27, trigger input 33, and reduction in size of range sensor 12.

In alternate embodiments (not shown), the iPhone 11 is inserted through the shroud 35 (rather than housing slot 23) and one or more holes in the alternate housing 21 provide access to the earphone jack. In these embodiments, the physical buttons on the iPhone are preferably covered and protected by flexible material.

Embodiments comprising mobile smart devices, such as iPhone 11 or Droid have several advantages over conventional rangefinders. First, the user has one less item to carry this reduces the overall weight and complexity. Second the range finding device has a lower incremental cost to manufacture, being just the alternate housing 21 and the range sensor 12. The processor (computing element 16), tilt sensor 14, digital camera 25, high-resolution display 31, and inputs 32 (including touch screen display inputs 34) of the mobile smart device is used to provide the necessary components of the digital rangefinder device 10. Third, the mobile smart device, such as iPhone 11, has other useful features such as global positioning system (GPS), virtual maps, satellite images, emergency communications, video capture, video playback, digital photographs, etc.

Advantages of mobile smart device are explained with an exemplary scenario. The user uses the GPS and satellite images to travel to a hunting spot identified on a previous trip; however the topographical maps and satellite images allowed the user to find a more direct, shorter route. A group of targets are located in thick brush. The ring of fire mode is activated to approach the group of targets until a comfortable shoot range is reached. Zoom video is taken showing the details of the targets such as which are does and bucks, number of points on the antlers, size of the animals. The dynamic clear shot trajectory mode is used to identify potential obstacles and to position the user and the weapon for a clear shot. The user notes the true aiming point (980), as well as angle and second range indicator 990. A photo is taken of a selected target. The photo is marked with the GPS coordinates and time. A second video is captured showing an animated projectile trajectory 2 path from a straight view (such as discussed in reference to FIGS. 28 and 29). The motion sensors of the iPhone 11 are used to determine any projectile inertia for a FIG. 29 scenario. A third video is captured showing the animated projectile trajectory 2 path from a side perspective view (such as discussed in reference to FIG. 32). The weapon is aimed based on the information provided by the device 10. When the projectile is fired, a fourth video is captured showing the actual projectile trajectory 2 and the success of failure of the shot. If Internet access is available via WiFi or via cellular wireless, the photo and videos can be uploaded to friends, video producers, or social networking sites. Any of the videos can be replayed.

In yet another more sophisticated embodiment of a very smart rangefinder device 10, an analysis of the second video can be compared to an analysis of the fourth video and the device 10 can automatically recalibrate to match the true trajectory captured in the fourth video. The true parabola values, the air drag and the cross wind drift can be determined and used for the next shot. After a series of shots in different directions the true wind direction and speed can be determined. Thus, the smart rangefinder device 10 learns from its environment. If a significant time has passed the previous wind direction and speed can be confirmed, or forgotten and relearned.

Full Projectile Trajectory Sequence Display

Figure 28:
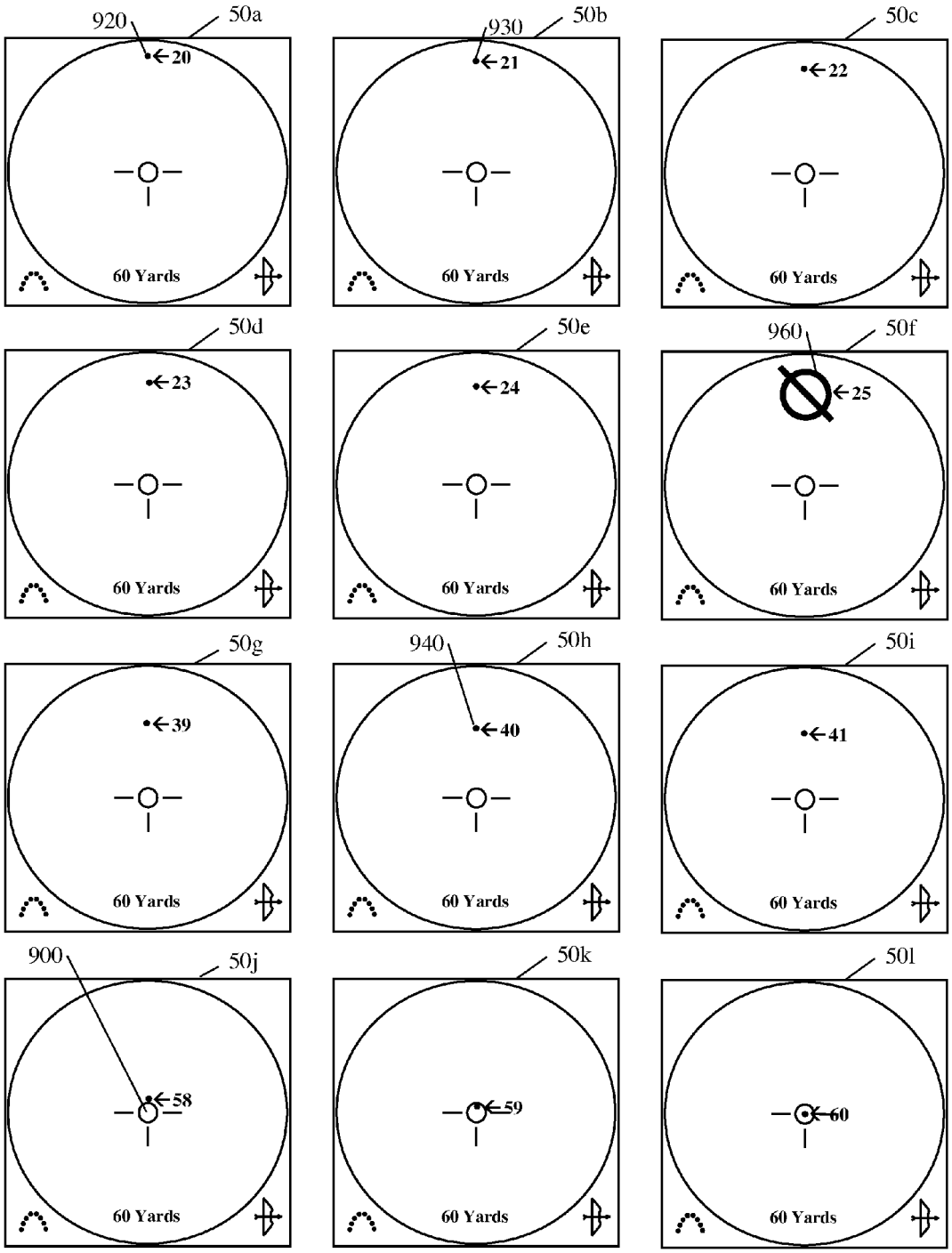
FIG. 28 illustrates a sequence of display frames, on a high-resolution display, showing the projectile trajectory at various points along the path.

FIG. 28 illustrates a sequence of display frames 50 (50*a* through 50*l*), on a high-resolution display 31, showing the projectile trajectory at various points along the path. This sequence illustrates how the clear shot technology dynamically determines the display locations for the path indicators.

Each frame shows a single path indicator 930 as a dot and also shows the intermediate range (as a number following an arrow) that the dot represents in the trajectory path.

Frame 50*a* shows a twenty-yard indicator 920 followed by an arrow and the number twenty (e.g. ←20). The number indicates the number of yards of the intermediate range (true horizontal distance) to a point in the projectile trajectory 2 (see for example, FIG. 7D and FIG. 13A).

Frame 50*b* shows the path indicator 930 a little lower with a twenty-one yard intermediate range indication.

Frame 50*c* shows the path indicator dot still lower with a twenty-two yard intermediate range indication.

Frame 50*d* shows the path indicator dot still lower with a twenty-three yard intermediate range indication.

Frame 50*e* shows the path indicator dot still lower with a twenty-four yard intermediate range indication.

Frame 50*f* shows the path indicator dot still lower with a twenty-five yard intermediate range indication. In one embodiment, the dot is replace with the don't shoot indicator 960 (see discussion above regarding FIGS. 11C and 11D).

Skipping some frames in the full sequence, frame 50*g* shows the path indicator dot with a thirty-nine yard intermediate range indication. Because several frames have been skipped the dot is significantly lower.

Frame 50*h* shows the forty-yard indicator 940 with a forty yard intermediate range indication.

Frame 50*i* shows the path indicator dot with a forty-one yard intermediate range indication.

Skipping some frames again, frame 50*j* shows the path indicator dot with a fifty-eight yard intermediate range indication. Because several frames have been skipped the dot is significantly lower, just above the cross hairs 900.

Frame 50*k* shows the path indicator dot with a fifty-nine yard intermediate range indication.

Frame 50*l* shows the path indicator dot at the target, at 60 yards.

The full sequence from one yard (not shown) to 60 yards can be shown in an animation at one frame a second in sixty seconds, at six frames a second in ten seconds, or preferably at ten frames per second in six seconds. Such an animation provides projectile awareness for the full projectile trajectory 2 path. In the don't shoot indicator 960 embodiments, the obstacle that prevents the clear shot is clearly indicated in the animation. Alternatively, the portion of the optical image (as digitized) can be highlighted as discussed in reference to FIG. 30.

Also in frames 50 (*a*-1), the mode indicators (shown like 992 and 996 of FIG. 21) are shown outside the circular focus area and the distance indicator (shown like 910 of FIG. 30) uses a high-resolution font rather than a segmented display, as discussed above.

Full Projectile Trajectory Sequence Display with Drift Adjustments

Figure 29:
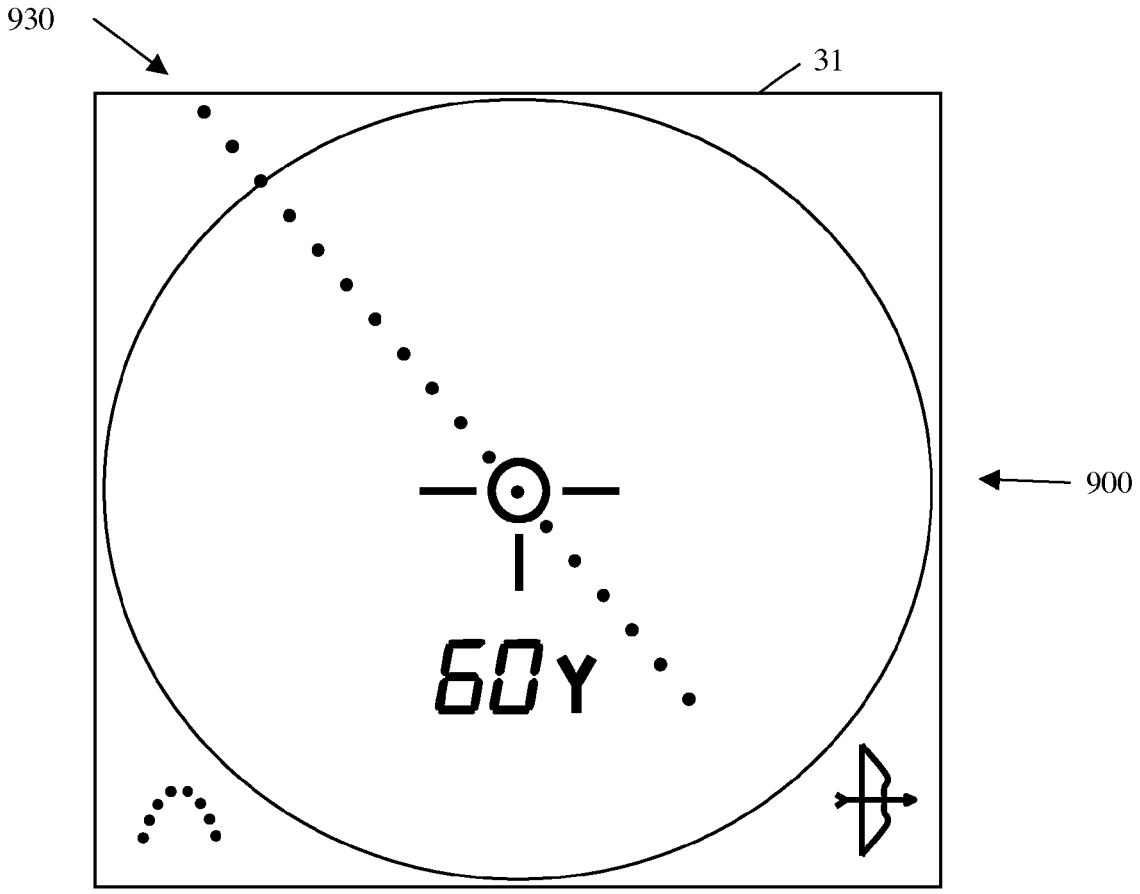
FIG. 29 illustrates a high-resolution display showing a plurality of locations on a projectile trajectory adjusted for wind or weapon inertia.

FIG. 29 illustrates a high-resolution display 31 showing a plurality of locations on a projectile trajectory adjusted for wind or weapon inertia.

Another advantage of the high-resolution display 31 is that the path indicators 930, shown in FIG. 29 as a sequence of dots, can be displayed anywhere on the display. For example, a cross wind will cause the projectile to drift. The user can enter data into the rangefinder device 10 to indicate the current relative cross wind speed (or estimate). The cross wind data can be correlated with projectile cross drag data to display a true aiming point (980 not shown) and show the corresponding diagonal sequence of points of the projectile trajectory. Preferably, an animation, as discussed in relation to FIG. 28, would show one point at a time with the corresponding intermediate range indication.

If a projectile is fired from a moving vehicle, such as a truck, jet, or a helicopter the projectile will have initial inertia (or acceleration) relative to the ground target. The computing element 16 (FIG. 3) can adjust the display to show the apparent drift resulting from the inertia (velocity and/or acceleration) of the projectile at the time of firing. In these situations the path on the display may be a curve and may rise from below the cross hairs (900).

Further, if the projectile misses the target, additional path indicators in an extended sequence could show where the projectile would be beyond the target. For example, the dots shown to the right of the cross hairs 900 could represent each yard after the target is missed. This provide projectile awareness in the case the target moves or is missed by the projectile.

Obstacle Image Highlighting

Figure 30:
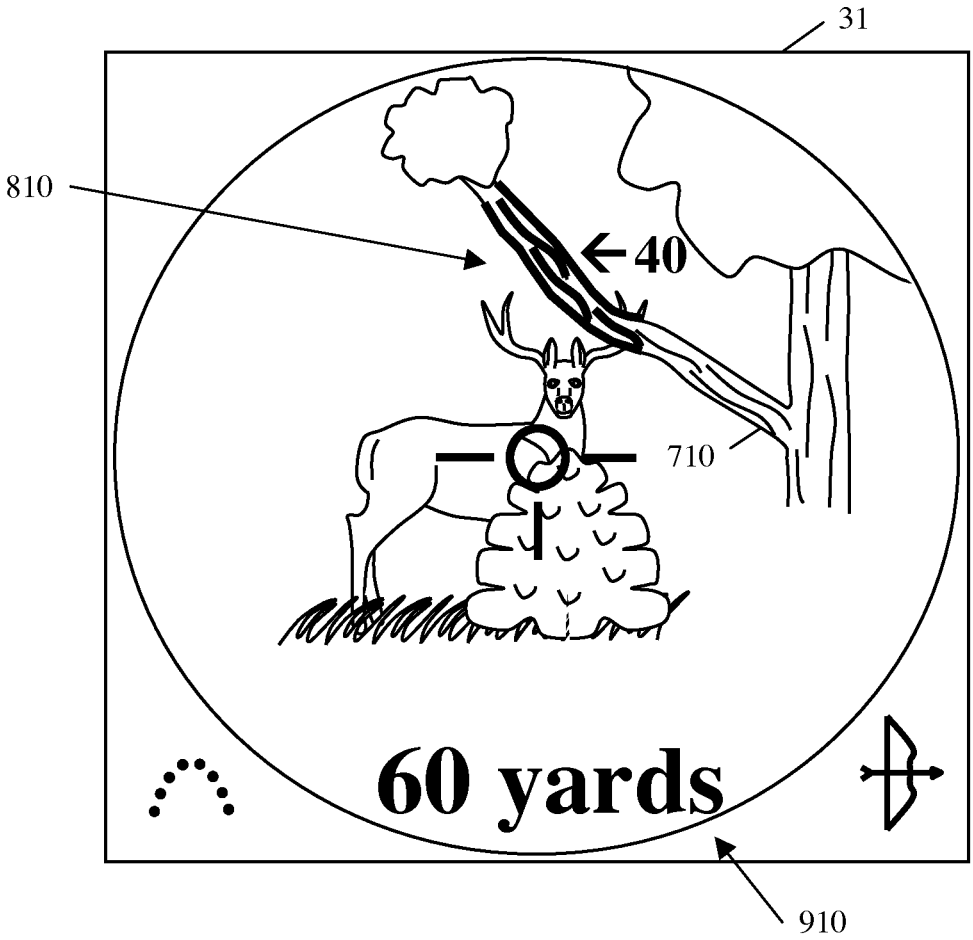
FIG. 30 illustrates a high-resolution display showing portions of an optical image that have been highlighted to show objects at an indicated range.

FIG. 30 illustrates a high-resolution display 31 showing portions of an optical image that has been highlighted to show objects at an indicated range. In this exemplary embodiment, a portion of the image of the tree branch 710 is shown with an image highlight 810. The image highlight 810 is done in various ways. As shown in FIG. 30, the computing element 16 (FIG. 3) in combination with the range sensor 12 (FIG. 3) has determined a portion of the branch 710 which has be ranged at 40 yards and highlighted the edges and features of the object, in this case the portion of the branch 710. Alternatively the portion of the object could be highlighted with a shade of red or yellow or some other color. Different colors could be used to indicate objects in the trajectory path versus objects that are clear, or to indicate objects at different intermediate ranges.

In this exemplary image, the tree branch 710 is an obstacle in the trajectory path at forty yards. The portion of the branch 710 that blocks the path is highlighted with the image highlight 810. In an automatic mode, the user could move the device 10 to a different location until the obstacle is no longer highlighted, indicating that a shot from that location would be clear.

FIG. 30 also illustrates advantages of the high-resolution display 31 wherein the distance indicator 910 is displayed with a high-resolution font which can be dynamically displayed in colors and at positions that do not adversely affect the visibility of the overlaid video image (as opposed to fixed segments of FIG. 10).

Ring of Fire Highlighting

Figure 31:
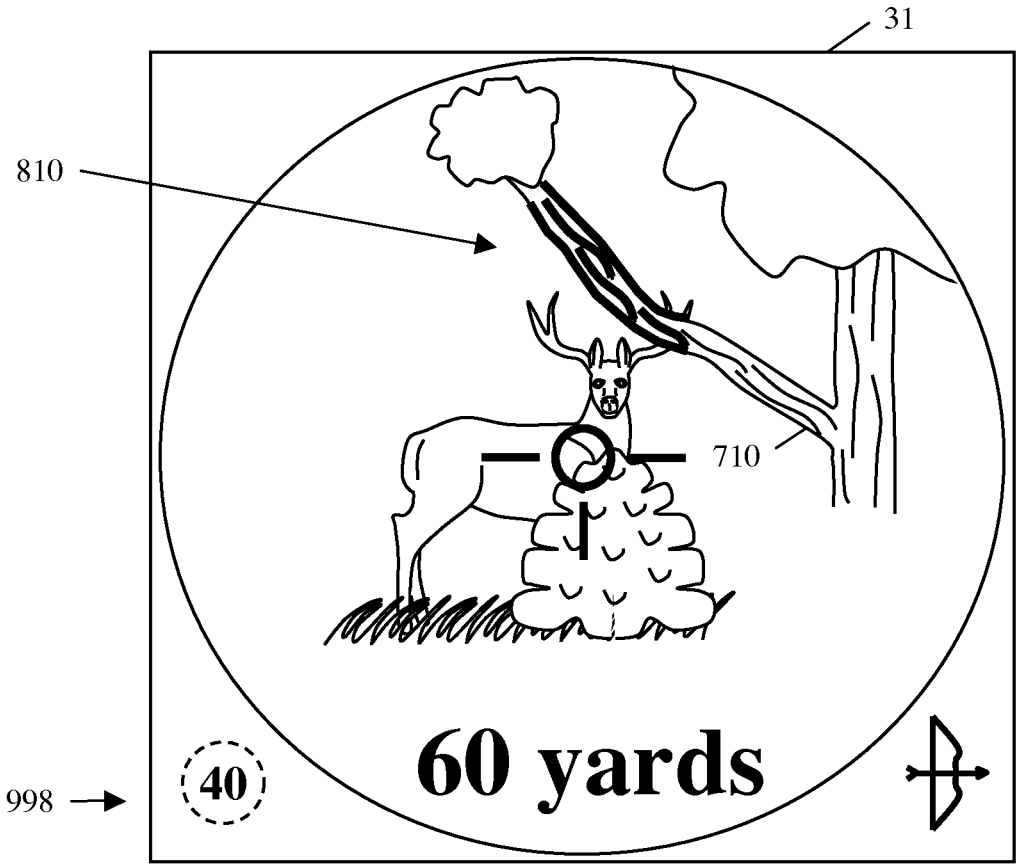
FIG. 31 illustrates a high-resolution display showing portions of an optical image that have been highlighted to show objects in the ring of fire.

FIG. 31 illustrates a high-resolution display showing portions of an optical image that has been highlighted to show objects in the ring of fire.

As discussed above, most bow hunters are comfortable shooting in a range between thirty and fifty yards. In ring of fire mode, any object which is at a predetermined range, such as forty yards, will be automatically highlighted with an image highlight 810 as the user moves device 10. The ring-of-fire indicator 998 is illuminated when the device 10 is in ring of fire mode.

The image highlight 810 is done in various ways. As shown in FIG. 31, the computing element 16 (FIG. 3) in combination with the range sensor 12 (FIG. 3) has determined a portion of the branch 710 which has be ranged at 40 yards and highlighted the edges and features of the object, in this case the portion of the branch 710. Alternatively the portion of the object could be highlighted with a shade of green or some other color.

In this exemplary image, the tree branch 710 is an object that is about forty yards away. The user is automatically informed by the image highlighting which objects are at the predetermined distances. The user is then able to use those objects as a reference for those objects that are a few yards closer (e.g. about greater than thirty yards) or a few yards farther away (e.g. about less than fifty yards). When approaching a group of targets, the user can approach until a centrally located object becomes highlighted, then each target will be at a comfortable shooting distance. Alternatively, when in a tree stand or when calling targets into a shooting area, a number of reference objects located at the predetermined distance, such as forty yards, such as a bush along a path, are automatically visualized.

Image Layer Projectile Trajectory Animation

FIG. 32 illustrates an animation on high-resolution display 31 showing portions of an optical image which has been split into image layers 800 that represent objects at respective ranges, the layers 800 being skewed to represent a side perspective and the animation showing the projectile moving through image layers 800 along the projectile trajectory 2.

As discussed above, in a digital rangefinder device 10 with a high-resolution display 31, the high-resolution display 31 does not have to display the video which currently being captured via the digital camera 25. A frame 50 of the video can be frozen and analyzed by the computing element 16, along with range data from the range sensor 12. Based on this analysis the image can be separated into a plurality of image layers 800, each image layer 800 showing only the portions of the image located at about the same distance.

In the exemplary illustration of FIG. 32, a tree with a branch 710 is located about 20 yards away and are shown in image layer 800*a*. Also the target T and a bush 730 are located together about sixty yards away and are shown in image layer 800*b*. Each image layer 800 is skewed to create a side perspective view and displayed relative to each other on the high-resolution display 31. The distance of the first image layer 800*a* is indicated below it, for example, indicated twenty yards. The distance of the second image layer 800*b* is indicated below it, for example, indicated sixty yards. These image layers 800 are exemplary; there could be any number of image layers at any range. For example, there could be a branch at ten yards, a tree at 23 yards, a bush at 45 yards, and a target at 57 yards.

Once the side perspective view is displayed, the projectile trajectory 2 can be displayed, preferably shown passing through each image layer 800. In one embodiment, the projectile could leave a trail as is passes. In another embodiment, the points along the path could be illuminated as the path is animated. In some embodiments, objects that are in the trajectory path are indicated with an image highlight 810 (as in FIG. 30) or with a don't shoot indicator 960 (similar to FIG. 11D). In an automatic mode, the user could move the device 10 to a different location until the object is no longer show as an obstacle, indicating that a shot from that location would be clear. In one automatic mode, the high-resolution display 31 automatically switch between live optical view and the image layer side perspective view. In another mode, the user would press an input to see the image layer side perspective view.

In yet another embodiment, every frame 50, such as the sixty frames discussed in reference to FIG. 28, is shown with an exemplary projectile flying through each frame in an animation. The frames 50 could be normal or could be skewed to create a side perspective view with a subset of the frames being visible on the screen at one time, e.g. three or four skewed frames would move across the screen relative to a stationary exemplary projectile until all sixty frames 50 have been displayed in sequence.

In yet another embodiment the high-resolution display 31 can be split into to panes. One pane showing the view of FIG. 28, FIG. 29, or FIG. 30 and the other pane showing the view of FIG. 32. The animations in both panes could be synchronized.

Virtual Bow Sight Pins

FIG. 33 illustrates a high-resolution display 31 showing a plurality of virtual bow sight pins, such as virtual twenty-yard pin 620, virtual forty-yard pin 640, and virtual sixty-yard pin 660.

In this simple embodiment, a user is able to position one or more one or more virtual bow sight pins at any position they want, forming a virtual bow sight that is consistent an individual bow.

FIG. 33 illustrates another advantage of the high-resolution display 31 wherein one or more virtual bow sight pins are dynamically displayed at any positions (as opposed to fixed segments such as those of FIG. 10). The color of the virtual bow sight pins can be selected by the user.

In embodiments where the focal range (or magnification factor) of the device 10 is fixed (e.g. 5× or 7×), the virtual bow sight pins are dynamically positioned, relative to cross hairs 900, based on the current range to the target as indicated by the distance indicator 910. The example shown has a distance indication of sixty yards so the virtual sixty-yard pin 660 is aligned with the cross hairs 900, and the virtual twenty-yard pin 620 and the virtual forty-yard pin 640 are at the fixed positions relative to the virtual sixty-yard pin 660. If a target were sensed at thirty yards, the group of virtual bow sight pins would be positioned such that the virtual twenty-yard pin 620 would be just above, and the virtual forty-yard pin 640 would be just below, respectively, the cross hairs 900. Likewise, if a target were sensed at forty five yards, the group of virtual bow sight pins would be positioned such that the virtual forty-yard pin 640 would be just slightly above the cross hairs 900.

In embodiments where the focal range (or magnification factor) of the device 10 is variable (e.g. with zoom in and zoom out capabilities), the virtual bow sight pins are dynamically positioned, relative to each other, based on the current magnification factor.

Although the invention has been described with reference to the preferred embodiments illustrated in the attached drawings, it is noted that equivalents may be employed and substitutions made herein without departing from the scope of the invention as recited in the claims.

ADVANTAGES

Accurate

The clear shot technology provides an accurate projective trajectory to a ranged target that takes into account the obstacles that may be in the trajectory.

Effective

Because the clear shot technology provides an accurate projective trajectory to a ranged target that takes into account the obstacles that may be in the trajectory, the user can adjust the position of the shot to ensure that an unexpected obstacle will not interfere with the shot. Thus, the first shot will always reach its target being more effective.

Confidence

The clear shot technology gives the user confidence that despite numerous obstacles that may be near a projectile trajectory that a difficult shot can be successfully taken. This increased confidence will improve the user's performance and satisfaction.

Increased Safety

The clear shot provides increased safety. In some embodiments any obstacle in the projectile trajectory is indicated in the display. In a situation where obstacles cannot be ranged because of intervening obstacles, the clear shot indication is not provided. Thus, the user is assured that any obstacle that may be impacted by the projectile will not be unknowingly harmed.

Adjustable

The embodiments of these displays and rangefinders can be adjusted to be consistent with an individual user and associated sights, for example the specific pins on a individual user's bow sight.

Lightweight

The enhanced features of the clear shot technology do not add weight to the convention device. Embodiments with a digital camera and a high-resolution display have lighter weight than conventional rangefinders.

Easy to Transport and Use

Devices containing the clear shot technology are easy to transport and use. Embodiments with a digital camera and a high-resolution display are smaller.

Fun

Games containing displays simulating the clear shot technology are fun to play and help introduce a new generation of potential sportsman to the archery and shoot sports.

Conclusion, Ramification, And Scope

Accordingly, the reader will see that the enhanced displays, rangefinders, and methods provide important information regarding the projectile trajectory and importantly provide greater accuracy, effectiveness, and safety.

While the above descriptions contain several specifics these should not be construed as limitations on the scope of the invention, but rather as examples of some of the preferred embodiments thereof. Many other variations are possible. For example, the display can be manufactured in different ways and/or in different shapes to increase precision, reduce material, or simplify manufacturing. Further, the clear shot technology could be applied to military situations where the projectiles is fired from a cannon, tank, ship, or aircraft and where the obstacles could be moving objects such as helicopters or warfighters. Further, the path indicators could indicate points in the trajectory beyond the target, should the projectile miss the target. On the battlefield with three dimensional information, e.g. from satellite imaging and computer maps and charts, a computer using clear shot technology could aim an fire multiple weapons over mountains and through obstacles to continuously hit multiple targets. Additionally, the clear shot technology could be applied to golf where in a golf mode the device would indicate which club would result in a ball trajectory that would provide a clear shot through trees and branches. The variations could be used without departing from the scope and spirit of the novel features of the present invention.

Accordingly, the scope of the invention should be determined not by the illustrated embodiments, but by the appended claims and their legal equivalents.

The invention claimed is:

1. A system for indicating to a user a clear shot along a projectile trajectory to a target, the system comprising:

a) a computing element for determining the projectile trajectory, b) a display having a plurality of trajectory path indicators, and c) a memory connected to the computing element, wherein the display is connected to the computing element, and wherein one of the trajectory path indicators indicates a height of the projectile trajectory at a predetermined intermediate range to the target, whereby the user is informed regarding whether or not an obstacle is in the projectile trajectory.

2. The system of claim 1, wherein the display comprises a plurality of selectively illuminated segments, wherein the one of the trajectory path indicators is one of the plurality of selectively illuminated segments.

3. The system of claim 1, the system comprising a scope to be mounted on a weapon for releasing a projectile, wherein the display comprises cross hairs located in the center of the display, wherein the scope is calibrated at a predetermined calibration distance when the cross hairs are positioned on the target at the predetermined calibration distance, and, wherein the trajectory path indicators are displayed above the cross hairs when the target is at a target distance greater than and equal to the calibration distance.

4. The system of claim 1, wherein a position of at least one of the trajectory path indicators is correlated to a bow sight of an individual bow.

5. The system of claim 1, wherein a first trajectory path indicator of the trajectory path indicators is a twenty-yard indicator.

6. The system of claim 1, wherein a second trajectory path indicator of the trajectory path indicators is a forty-yard indicator.

7. The system of claim 1, wherein a plurality of indicators on the display, including the trajectory path indicators, are superimposed over an optical image of the target.

8. The system of claim 7, wherein the plurality of indicators include a trajectory mode indicator which when illuminated indicates that the system in a mode where it is displaying the one of the trajectory path indicators to indicate the height of the projectile trajectory at the predetermined intermediate range to the target, wherein the trajectory mode indicator is distinct and separate from the plurality of trajectory path indicators.

9. The system of claim 7, wherein the plurality of indicators include an indicator indicating that the shot is not clear.

10. The system of claim 7, wherein the plurality of indicators include an indicator indicating a calibrated aiming point which is the maximum height of the projectile trajectory.

11. The system of claim 1, further comprising:

d) a housing containing the computing element, the display, and the memory, e) a range sensor for determining a first line of sight distance to the target, f) a tilt sensor for determining a line of sight angle to the target, g) at least one input on the surface of the housing, h) a lens for receiving an optical image of the target and at least one obstacle, and i) an eyepiece for viewing the display, wherein the range sensor, tilt sensor, and input are connected to the computing element, wherein the lens and eyepiece are connected to the housing, wherein the system is a handheld rangefinder device.

12. The system of claim 11, further comprising a digital camera, wherein the display is a high-resolution display, and wherein the handheld rangefinder device is a high-resolution handheld rangefinder device.

13. The system of claim 12, further comprising a global positioning system, wherein the global positioning system provides location coordinates.

14. The system of claim 12, wherein the computing element, display, and memory comprise a mobile smart phone.

15. The system of claim 11, wherein the display comprises cross hairs located in the center of the display, said cross hairs indicating line of sight to the target, wherein the trajectory path indicators are displayed above the cross hairs.

16. The system of claim 12, wherein the display further comprises at least one virtual pin.

17. The system of claim 1, further comprising:

d) a virtual world comprising the target and one or more obstacles stored in the memory, e) data for determining a relative direction, distance, and elevation for each object in the virtual world, and f) at least one input, wherein the input is connected to the computing element, wherein the computing element determines angles to the target and to the obstacle, wherein the system is a simulation game device.

18. The system of claim 17, wherein the computing element, display, and memory comprise a mobile smart phone.

19. A method of using the system of claim 1, comprising the steps of:

i) determining a first range to a target, ii) determining the projectile trajectory, iii) dynamically displaying at least one of trajectory path indicators, iv) determining the range to at least one obstacle, and v) determining whether or not the obstacle is in the projectile trajectory.

* * * * *